US010962927B2

(12) United States Patent
Fujiwara et al.

(10) Patent No.: US 10,962,927 B2
(45) Date of Patent: Mar. 30, 2021

(54) CARTRIDGE AND IMAGING FORMING APPARATUS

(71) Applicant: CANON KABUSHIKI KAISHA, Tokyo (JP)

(72) Inventors: Akihiro Fujiwara, Mishima (JP); Tadashi Horikawa, Numazu (JP); Naoki Matsumaru, Suntou-gun (JP); Ryuta Murakami, Suntou-gun (JP); Daisuke Makiguichi, Izunokuni (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/682,372

(22) Filed: Nov. 13, 2019

(65) Prior Publication Data

US 2020/0081396 A1 Mar. 12, 2020

Related U.S. Application Data

(62) Division of application No. 16/250,239, filed on Jan. 17, 2019, now Pat. No. 10,627,780.

(30) Foreign Application Priority Data

Jan. 23, 2018 (JP) ..... JP2018-008680
Mar. 12, 2018 (JP) ..... JP2018-044160

(51) Int. Cl.
*G03G 21/18* (2006.01)
*G03G 15/08* (2006.01)

(52) U.S. Cl.
CPC ..... *G03G 21/1885* (2013.01); *G03G 15/0863* (2013.01); *G03G 21/1846* (2013.01); *G03G 21/1871* (2013.01)

(58) Field of Classification Search
CPC ..... G03G 21/1885
See application file for complete search history.

(56) References Cited

U.S. PATENT DOCUMENTS 6,385,416 B1 5/2002 Horikawa et al.
6,553,189 B2 4/2003 Miyamoto et al.
(Continued)

FOREIGN PATENT DOCUMENTS

JP 2004-302019 A 10/2004
JP 2013-122579 A 6/2013

OTHER PUBLICATIONS

Feb. 8, 2021 Office Action in Korean Patent Application No. 10-2019-0008950.

*Primary Examiner* — Clayton E. LaBalle
*Assistant Examiner* — Leon W Rhodes, Jr.
(74) *Attorney, Agent, or Firm* — Venable LLP

(57) ABSTRACT

A cartridge mountable to and dismountable from a main assembly of an image forming apparatus includes a memory, a guide configured to guide a portion-to-be-guided provided in the main assembly and to guide a main assembly contact provided in the main assembly to a memory contact of the memory when the cartridge is mounted in the main assembly, and a grip portion. The guide is provided at a bottom of the cartridge when the cartridge is hung by gripping the grip portion and constitutes a part of a supporting portion configured to support the cartridge when the cartridge is placed on a horizontal placement surface. The guide has a chamfered surface formed by being chamfered. When the cartridge is supported at the supporting portion, the chamfered surface opposes the horizontal placement surface, and a surface of the memory contact is inclined with respect to the horizontal placement surface.

9 Claims, 38 Drawing Sheets

(56) References Cited

U.S. PATENT DOCUMENTS 6,681,088 B2 1/2004 Kanno et al.
6,735,405 B2 5/2004 Yokoi et al.
6,836,639 B2 12/2004 Karakama et al.
6,898,392 B2 5/2005 Karakama et al.
6,934,485 B2 8/2005 Miyabe et al.
6,963,706 B2 11/2005 Morioka et al.
6,987,938 B2 1/2006 Murakami et al.
7,024,131 B2 4/2006 Komatsu et al.
7,062,195 B2 6/2006 Kurihara et al.
7,156,797 B2 1/2007 Komatsu et al.
7,203,442 B2 * 4/2007 Matsubara ..... G03G 21/1867 399/90
7,206,534 B2 4/2007 Murakami
7,366,440 B2 4/2008 Horikawa
7,386,241 B2 6/2008 Mori et al.
7,614,732 B2 * 11/2009 Miyazawa ..... B41J 2/17509 347/86
7,840,160 B2 * 11/2010 Shimomura ..... G03G 21/1652 399/119
7,933,534 B2 4/2011 Hoshi et al.
8,238,784 B2 8/2012 Kusudo et al.
8,249,485 B2 8/2012 Horikawa et al.
8,311,449 B2 11/2012 Kusudo et al.
8,515,306 B2 8/2013 Kawai et al.
8,620,181 B2 12/2013 Murakami
8,682,211 B2 3/2014 Hoshi et al.
8,873,992 B2 10/2014 Sasaki et al.
9,026,009 B2 5/2015 Takahashi et al.
9,052,638 B2 6/2015 Matsumaru et al.
9,069,289 B2 6/2015 Batori et al.
9,116,466 B2 8/2015 Makiguchi et al.
9,164,424 B2 10/2015 Nakamura et al.
9,164,430 B2 10/2015 Murakami et al.
9,182,733 B2 11/2015 Horikawa et al.
9,188,906 B2 11/2015 Batori et al.
9,188,945 B2 11/2015 Anan et al.
9,229,371 B2 1/2016 Murakami et al.
9,360,834 B1 * 6/2016 Payne ..... G03G 21/1867
9,423,765 B2 8/2016 Fujii
9,465,318 B2 10/2016 Takeuchi et al.
9,523,942 B2 12/2016 Taeuchi et al.
9,599,932 B2 3/2017 Takeuchi et al.
9,778,616 B2 10/2017 Hiramatsu et al.
9,989,892 B2 6/2018 Takeuchi et al.
10,000,064 B2 6/2018 Katsuki et al.
10,095,161 B2 10/2018 Takeuchi et al.
10,095,180 B2 10/2018 Harada et al.
10,191,446 B2 * 1/2019 Miyamoto ..... G03G 21/1652
2004/0028429 A1 2/2004 Matsumaru
2014/0086597 A1 3/2014 Tanabe et al.
2017/0248869 A1 8/2017 Matsumoto et al.
2019/0129356 A1 5/2019 Murakami et al.
2019/0179257 A1 6/2019 Murakami et al.

* cited by examiner (a)

(b)

VW5

VW6

CARTRIDGE AND IMAGING FORMING APPARATUS

FIELD OF THE INVENTION AND RELATED ART

The present invention relates to a cartridge mountable to and dismountable from an apparatus main assembly of an image forming apparatus and usable for forming an image on a recording material, and relates to the image forming apparatus including the cartridge.

The image forming apparatus is an electrophotographic image forming apparatus, for example. The electrophotographic image forming apparatus forms the image on the recording material by using an electrophotographic image forming type. As an example of the electrophotographic image forming apparatus, an electrophotographic copying machine, an electrophotographic printer (LED printer, laser beam printer or the like), a facsimile machine, a multifunction machine having a plurality of functions of these machines, a word processor, and the like are included.

On the recording material, the image is formed by the image forming apparatus, and for example, the recording material includes paper, an OHT sheet and the like. The recording material also includes an intermediary transfer member, an image display member (white member) of the image forming apparatus, and the like.

The cartridge is for example a process cartridge or a developing cartridge and contributes to an image forming process for forming the image on the recording material in a state in which the cartridge is detachably mounted in the apparatus main assembly of the image forming apparatus. The apparatus main assembly of the image forming apparatus refers to an apparatus constituent portion obtained by excluding the cartridge from constituent elements of the image forming apparatus.

The process cartridge is prepared by integrally assembling a rotatable image bearing member for forming a latent image thereon and at least one of, as process means actable on the image bearing member for image formation, a charging means, a developing means, a cleaning means and the like into a cartridge. Then, the process cartridge is detachably mounted in the apparatus main assembly. The image bearing member is an electrophotographic photosensitive member in the electrophotographic image forming type, an electrostatic recording dielectric member in an electrostatic recording image forming type, a magnetic recording (magnetic) material in a magnetic recording image forming type, or the like.

Accordingly, the process cartridge includes one which is prepared by integrally assembling the image bearing member and the developing means as the image forming process means into a cartridge and which is then detachably mounted in the apparatus main assembly. This process cartridge integrally including the image bearing member and the developing means is referred to as a process cartridge of a so-called integral type. Further, a process cartridge integrally including the image bearing member and the process means other than the developing means is referred to as a process cartridge of a so-called function separate type. That is, a process cartridge for forming the image by being paired with a developing unit which includes the developing means and which is a separate member from the process cartridge is referred to as the process cartridge of the so-called function separation type.

Further, the developing cartridge includes a developer carrying member (developing roller) for providing a developer (toner) to the image bearing member and accommodates the developer used for developing the latent image formed on the image bearing member, and is detachably mounted in the apparatus main assembly. In the case of the developing cartridge, the image bearing member is rotated in the apparatus main assembly or on a cartridge supporting member. Or, the image bearing member is provided in the process cartridge of the so-called function separation type. In this case, the process cartridge does not include the developing means.

Therefore, the cartridge includes the process cartridge of the so-called integral type or the so-called function separation type. Further, the cartridge includes the case where the process cartridge of the so-called function separation type and the developing cartridge are paired with each other. Further, the cartridge includes the case where the image bearing member is fixedly mounted in the apparatus main assembly or on the cartridge supporting member and the developing cartridge is used mountable to and dismountable from the apparatus main assembly so as to be actable on the image bearing member. Further, the cartridge includes a developer cartridge accommodating the developer (toner) supplied to the process cartridge or the developing cartridge.

In the electrophotographic image forming apparatus, the electrophotographic photosensitive member generally of a drum type as the image bearing member, i.e., a photosensitive drum is electrically charged uniformly. Then, the charged photosensitive drum is subjected to selective exposure to light, whereby an electrostatic latent image (electrostatic image) is formed. Then, the electrostatic latent image formed on the photosensitive drum is developed into a toner image with toner as developer.

Thereafter, the toner image is transferred from the photosensitive drum onto the recording material (medium) such as a recording sheet or a plastic sheet, and then heat and pressure are applied to the toner image transferred on the recording material, so that the toner image is fixed on the recording material and thus image recording is effected. Such an image forming apparatus requires toner supply and maintenance of various process means in general. In order to facilitate the toner supply and the maintenance, a process cartridge type in which the photosensitive drum, a charging means, a developing means, a cleaning means and the like are integrally assembled into a cartridge in a frame and the cartridge is used as a process cartridge detachably mountable to an image forming apparatus main assembly has been put into practical use.

According to this cartridge type, a part of maintenance of the image forming apparatus can be made by a user himself (herself) without relying on a service person in charge of after-sales service. For that reason, operativity of the apparatus can be remarkably improved, so that it is possible to provide an image forming apparatus excellent in usability. For that reason, the cartridge type has been widely used in the image forming apparatus.

Here, a method in which the cartridge incorporates a memory (storing means, storing element) and maintenance and improvement in print quality are facilitated by registering service information and print quality information in the memory is employed.

The cartridge is taken out of the image forming apparatus during an exchange thereof and is placed on a horizontal placement surface alone in some instances. At this time, an electrical contact of the memory is damaged in some cases.

In the invention disclosed in Japanese Laid-Open Patent Application 2004-302019, a portion extending from the neighborhood of a memory means to a cartridge mounting portion is formed so as to have an outer configuration including an arc, whereby the memory is protected.

However, when the cartridge is placed on a horizontal placement surface so that an outer diameter portion including the arc faces the horizontal placement surface, an attitude of the cartridge is not stabilized and falls down, so that there is concern about damage of a constituent member such as a photosensitive drum exposed to an outer surface of the cartridge.

Further, in a constitution in which in the cartridge, a guide for guiding a contact of the image forming apparatus to an electric contact of the memory is provided, when the guide is placed on the horizontal placement surface in contact with the horizontal placement surface, there is a possibility that the guide itself is deformed or broken.

SUMMARY OF THE INVENTION

According to an aspect of the present invention, there is provided a cartridge mountable to and dismountable from a main assembly of an image forming apparatus and usable for forming an image on a recording material, the cartridge comprising: a memory configured to store information on the cartridge; a guide configured to guide a portion-to-be-guided provided in the main assembly and to guide a main assembly contact provided in the main assembly to a memory contact of the memory when the cartridge is mounted in the main assembly; and a grip portion, wherein the guide is provided at a bottom of the cartridge when the cartridge is hung by gripping the grip portion and constitutes a part of a supporting portion configured to support the cartridge when the cartridge is placed on a horizontal placement surface, wherein the guide has a chamfered surface formed by being chamfered, and wherein when the cartridge is supported at the supporting portion, the chamfered surface opposes the horizontal placement surface, and a surface of the memory contact is inclined with respect to the horizontal placement surface.

Further features of the present invention will become apparent from the following description of exemplary embodiments with reference to the attached drawings.

BRIEF DESCRIPTION OF THE DRAWINGS

Part (a) and (b) of FIG. 1 are illustrations (for representing the feature of the present invention) of a cartridge (process cartridge) in an embodiment.

Figure 6:
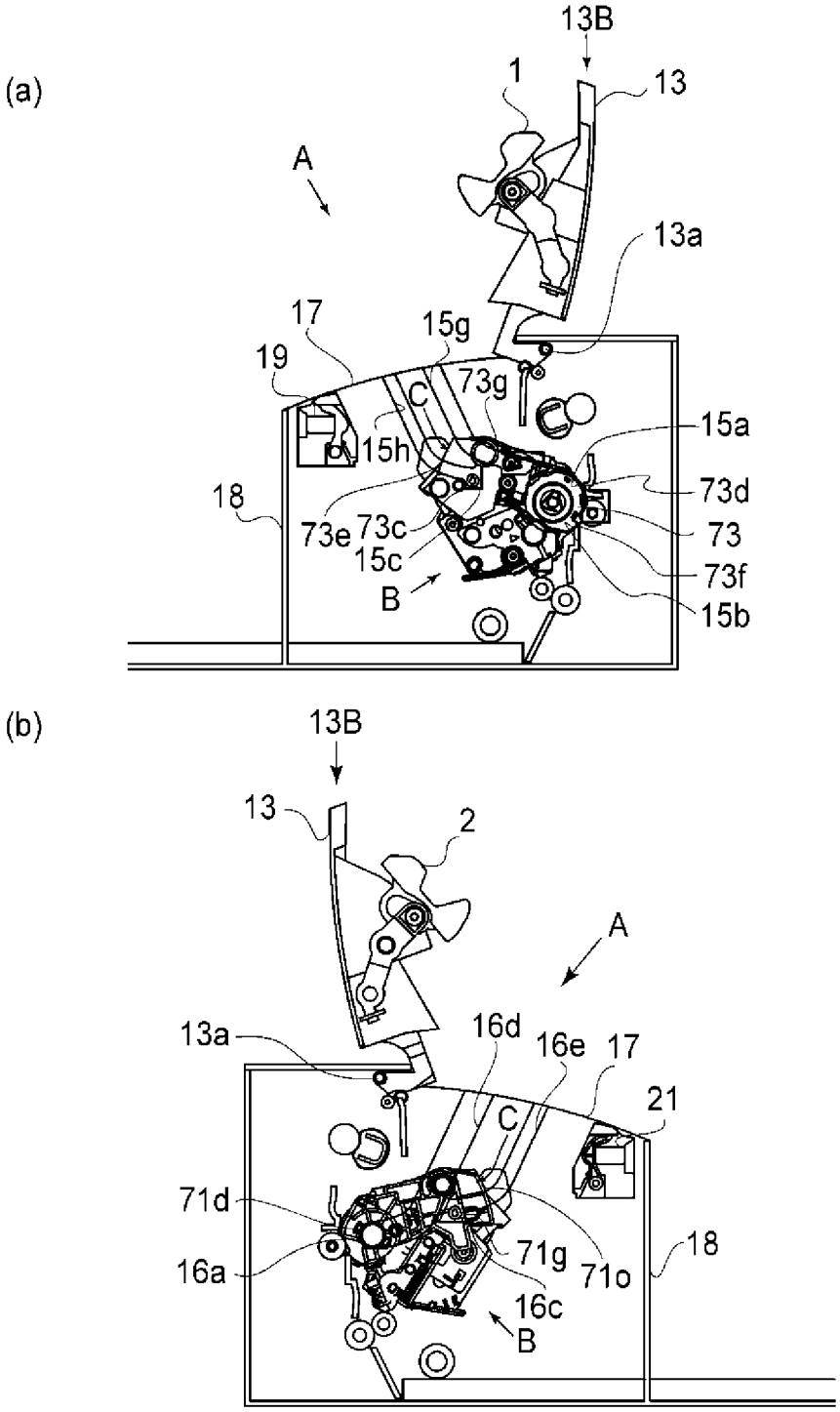

Parts (a) and (b) of FIG. 6 are illustrations of a cartridge guiding portion.

Figure 7:
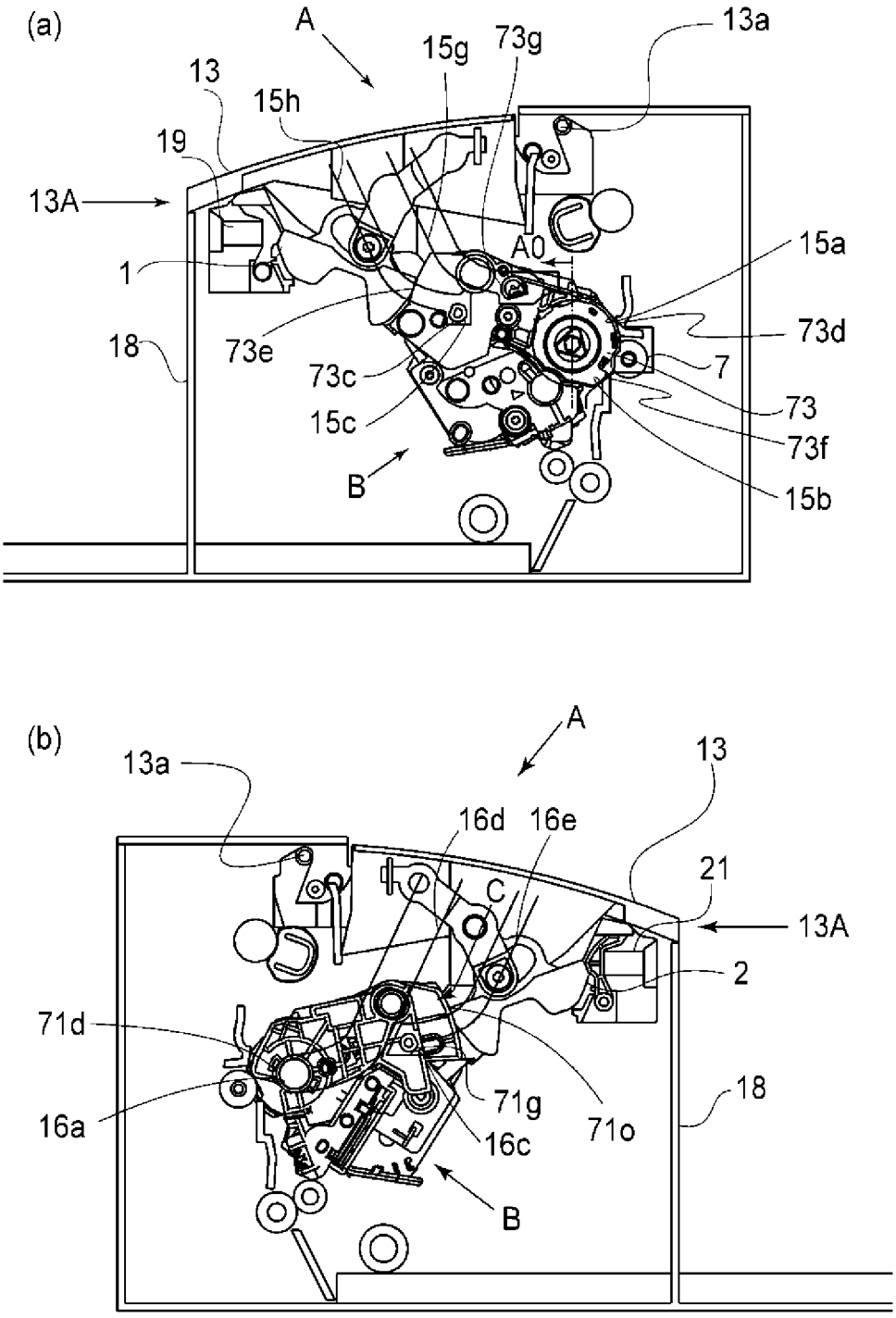

Parts (a) and (b) of FIG. 7 are illustrations of a cartridge positioning portion.

Figure 8:
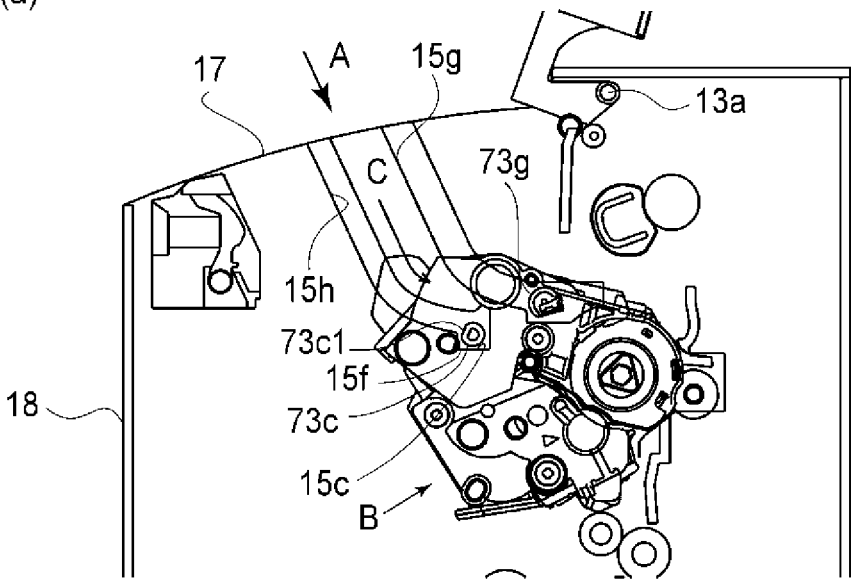
Figure 8:
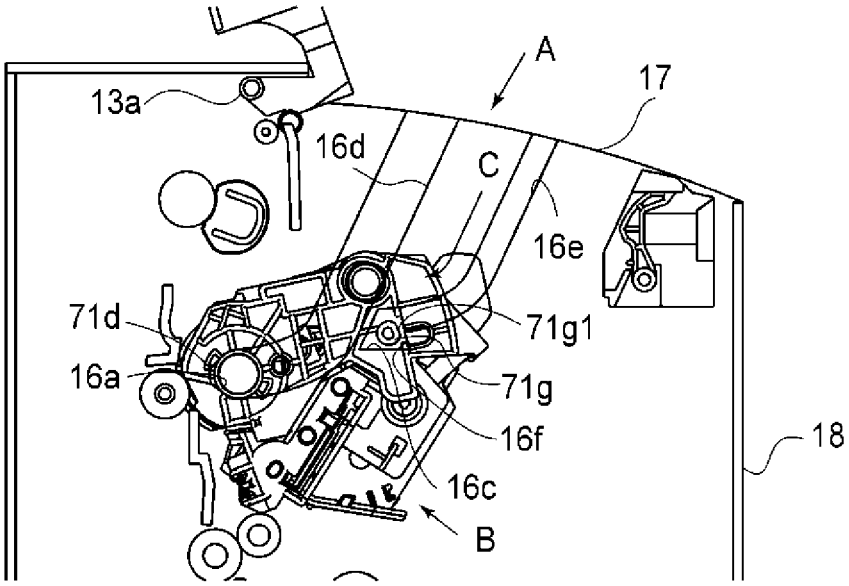

Parts (a) and (b) of FIG. 8 are illustrations of the cartridge guiding portion.

FIGS. 9A to 9D are illustrations of a drive transmission structure.

FIGS. 10A to 10D are illustrations of a memory tag structure.

Figure 11:
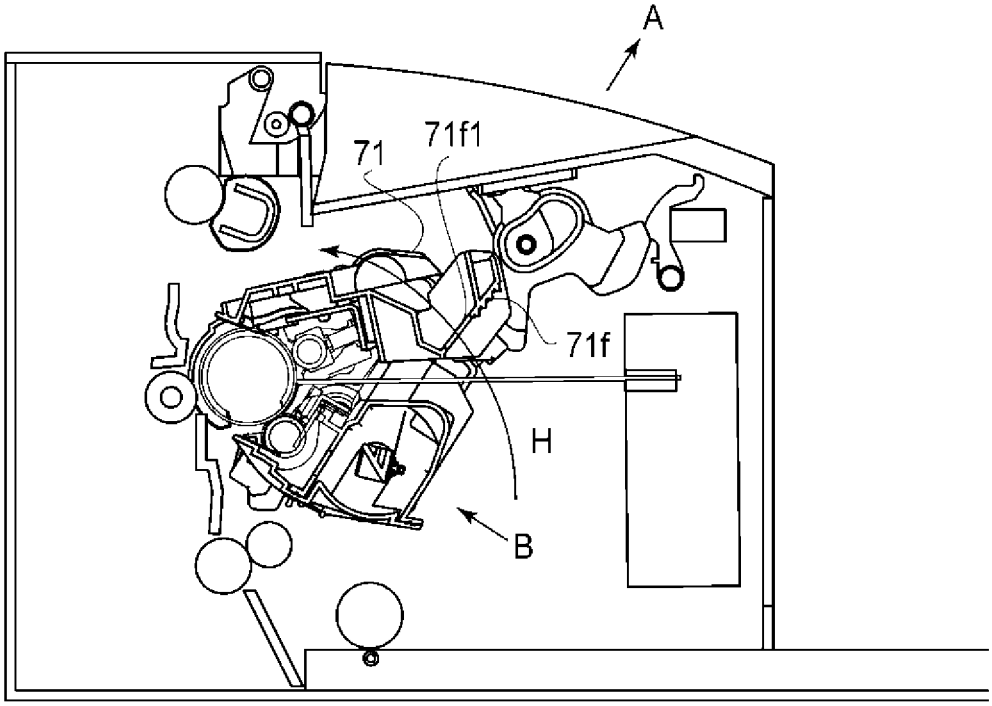

FIG. 11 is a schematic sectional view of the image forming apparatus.

Figure 12:
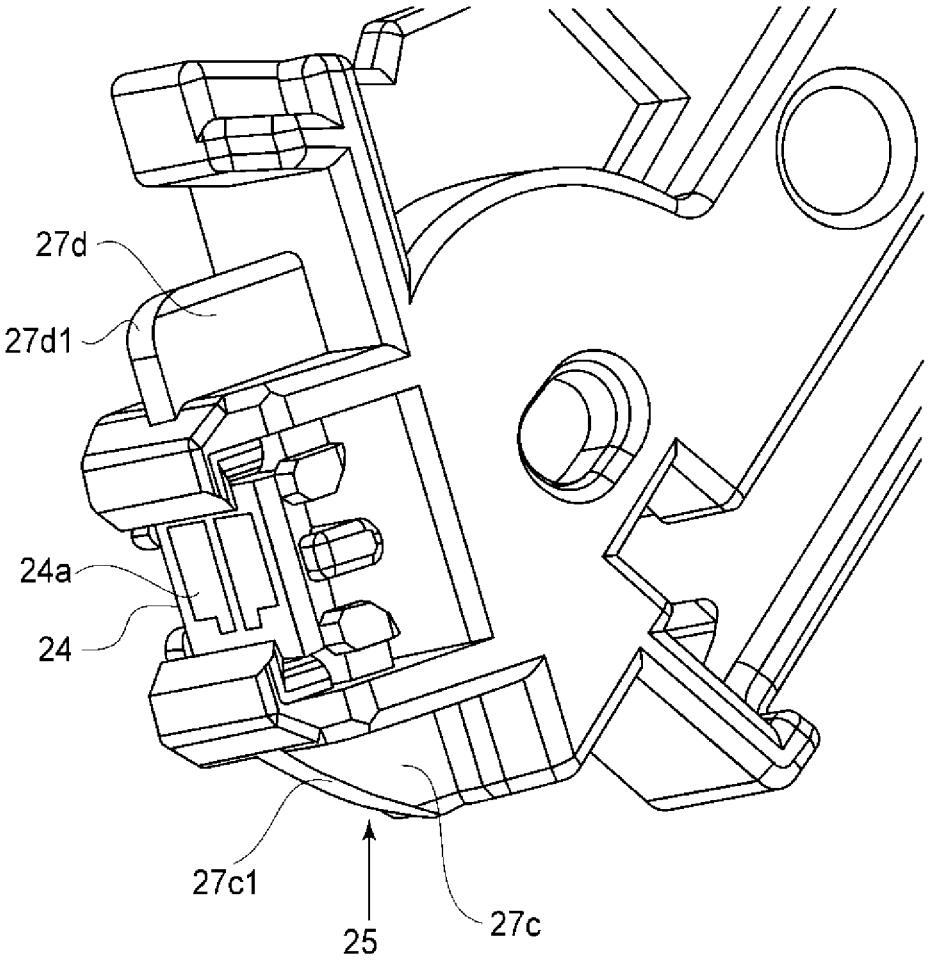

FIG. 12 is a perspective view showing a modified embodiment.

Figure 13:
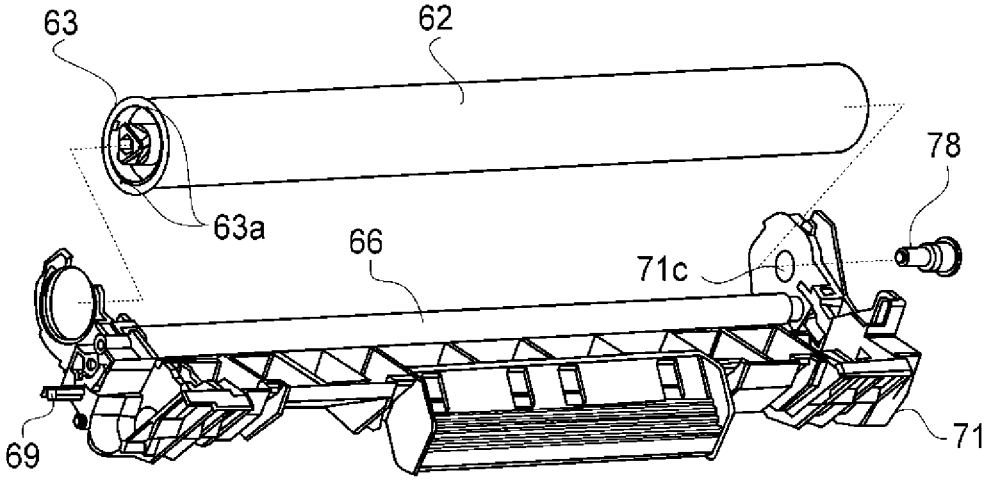

FIG. 13 is an illustration for assembling a drum unit according to the present invention.

Figure 14:
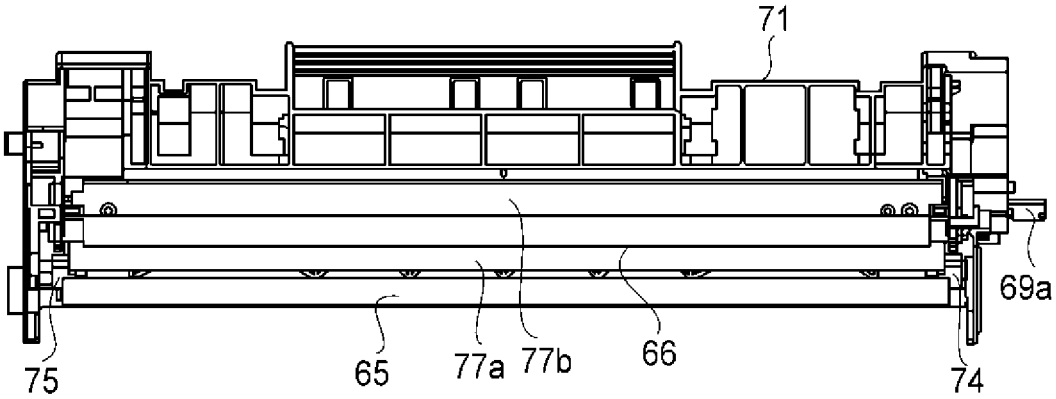

FIG. 14 is an illustration of a toner sealing structure of a cleaning unit according to the present invention.

Figure 15:
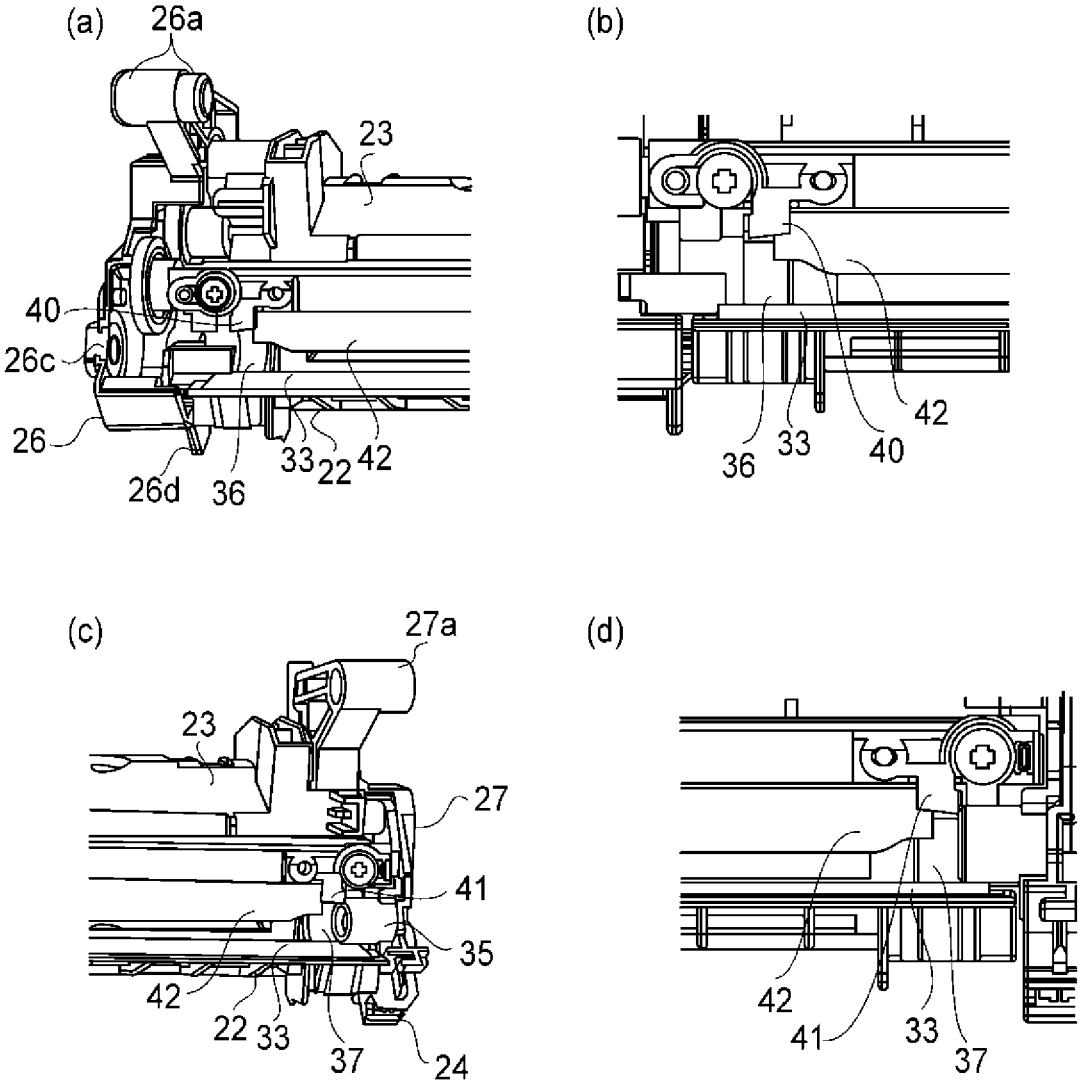

Parts (a) to (d) of FIG. 15 are illustrations of a toner sealing structure of a developing unit according to the present invention.

Figure 16:
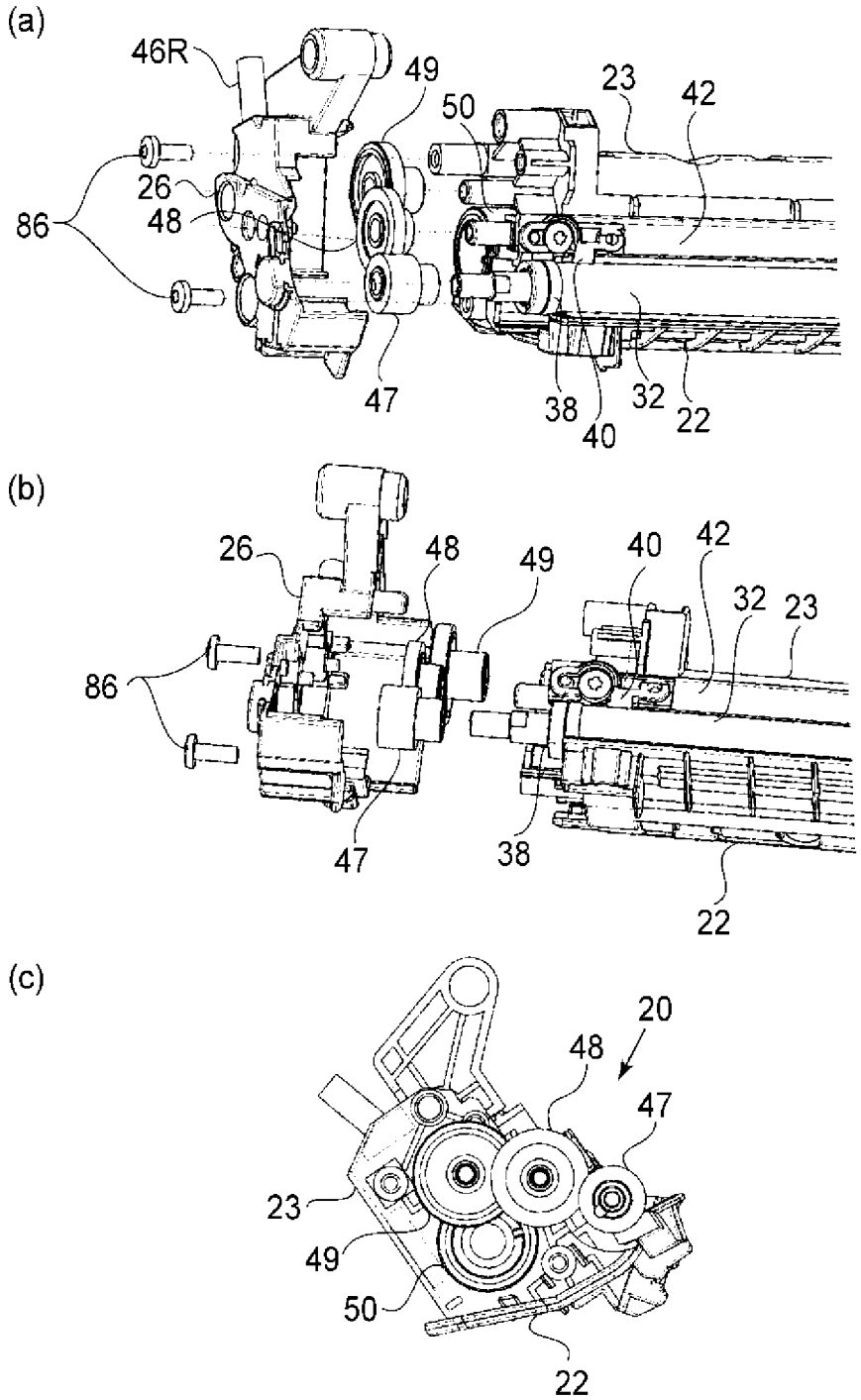

Parts (a), (b) and (c) of FIG. 16 are exploded views of the developing unit according to the present invention on a driving side.

Figure 17:
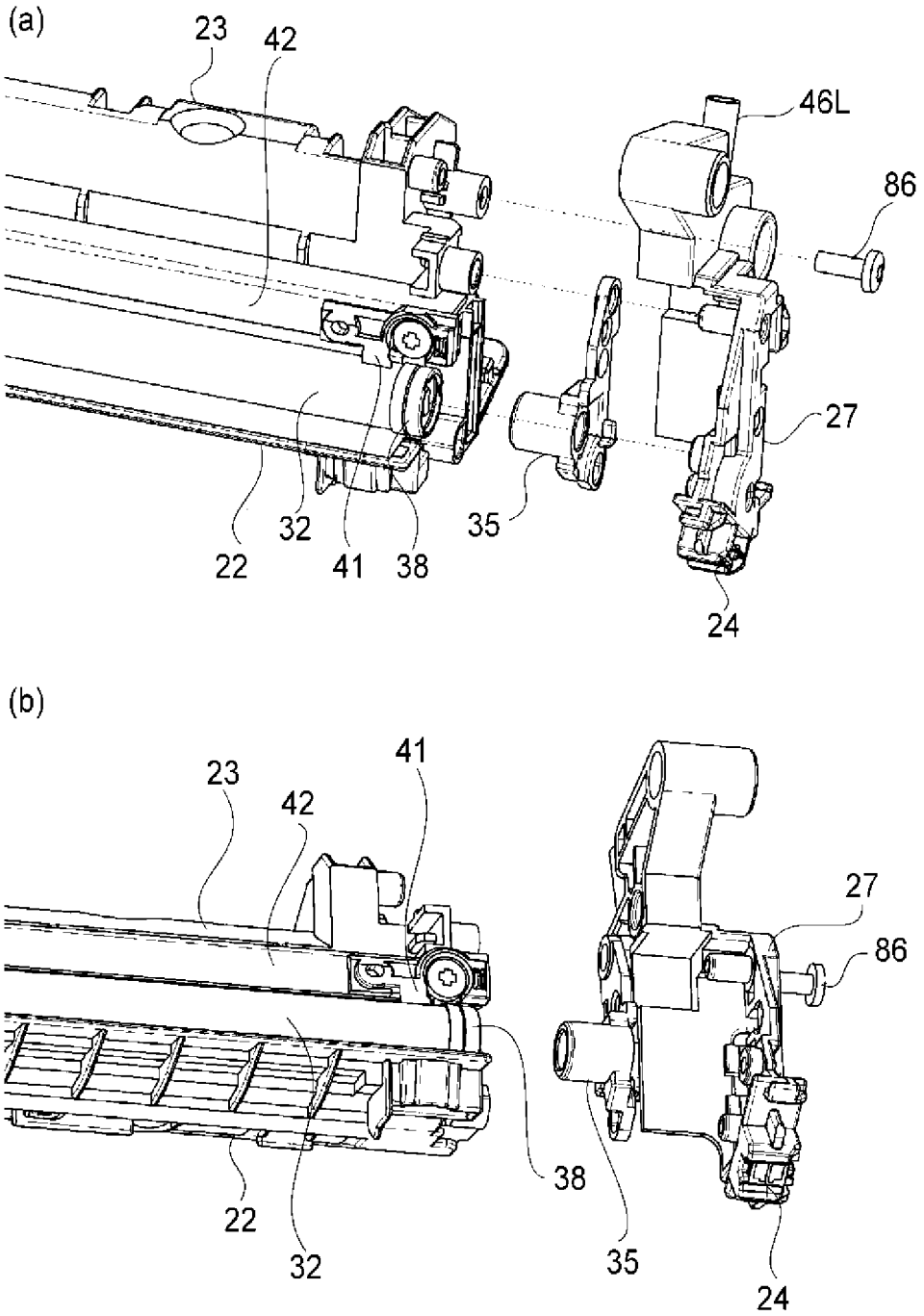

Parts (a) and (b) of FIG. 17 are exploded views of the developing unit according to the present invention on a non-driving side.

Figure 18:
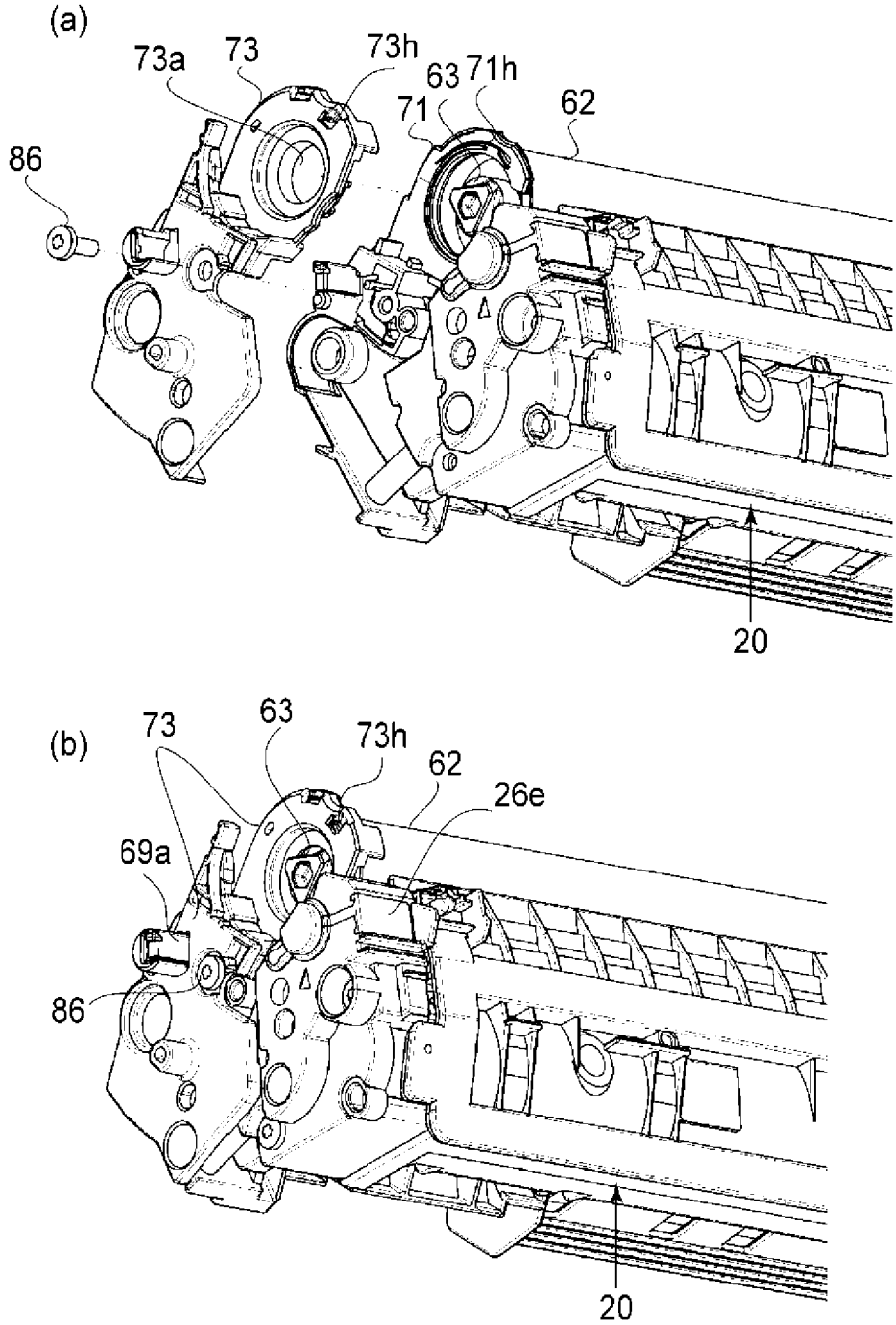

Parts (a) and (b) of FIG. 18 are illustrations for assembling a drum bearing according to the present invention.

Figure 19:
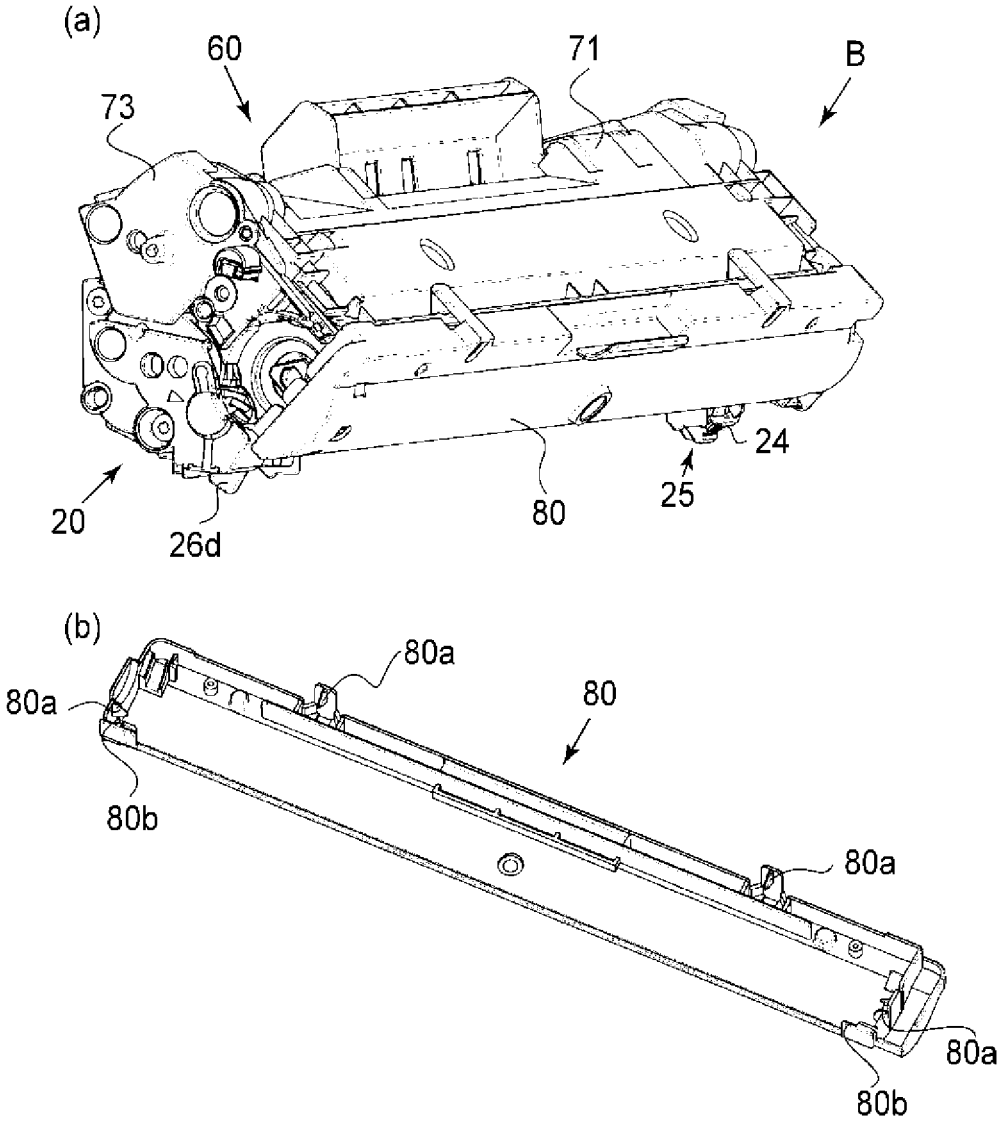

Parts (a) and (b) of FIG. 19 are illustrations of a protective member according to the present invention.

Figure 20:
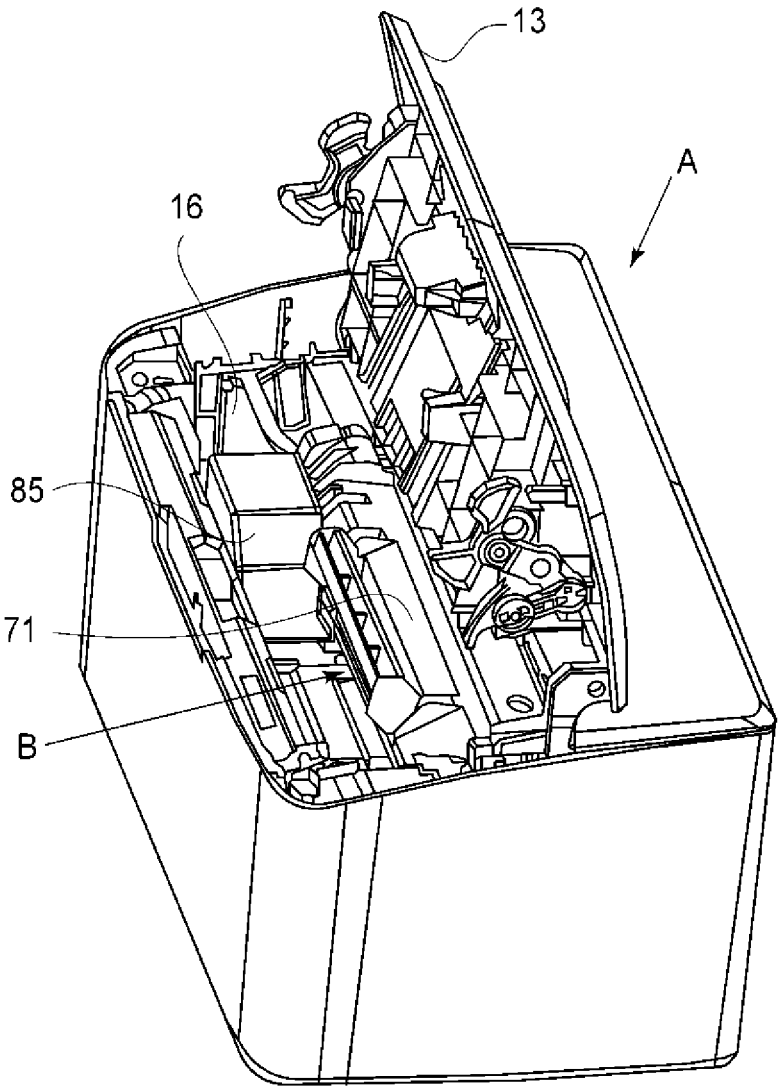

FIG. 20 is an illustration of a cushioning member mounted in the image forming apparatus according to the present invention.

Figure 21:
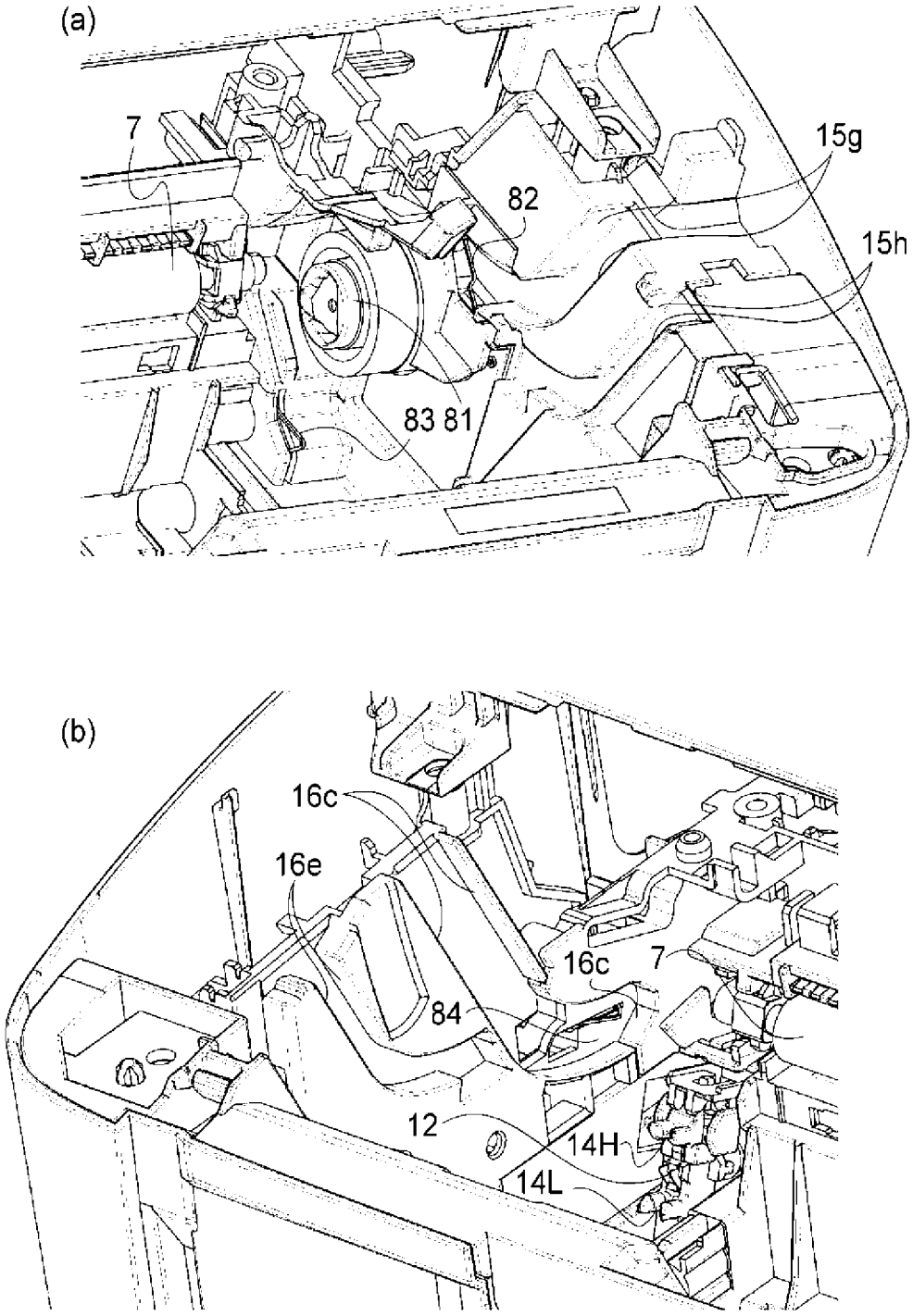

Parts (a) and (b) of FIG. 21 are illustrations of a contact structure of the image forming apparatus according to the present invention.

Figure 22:
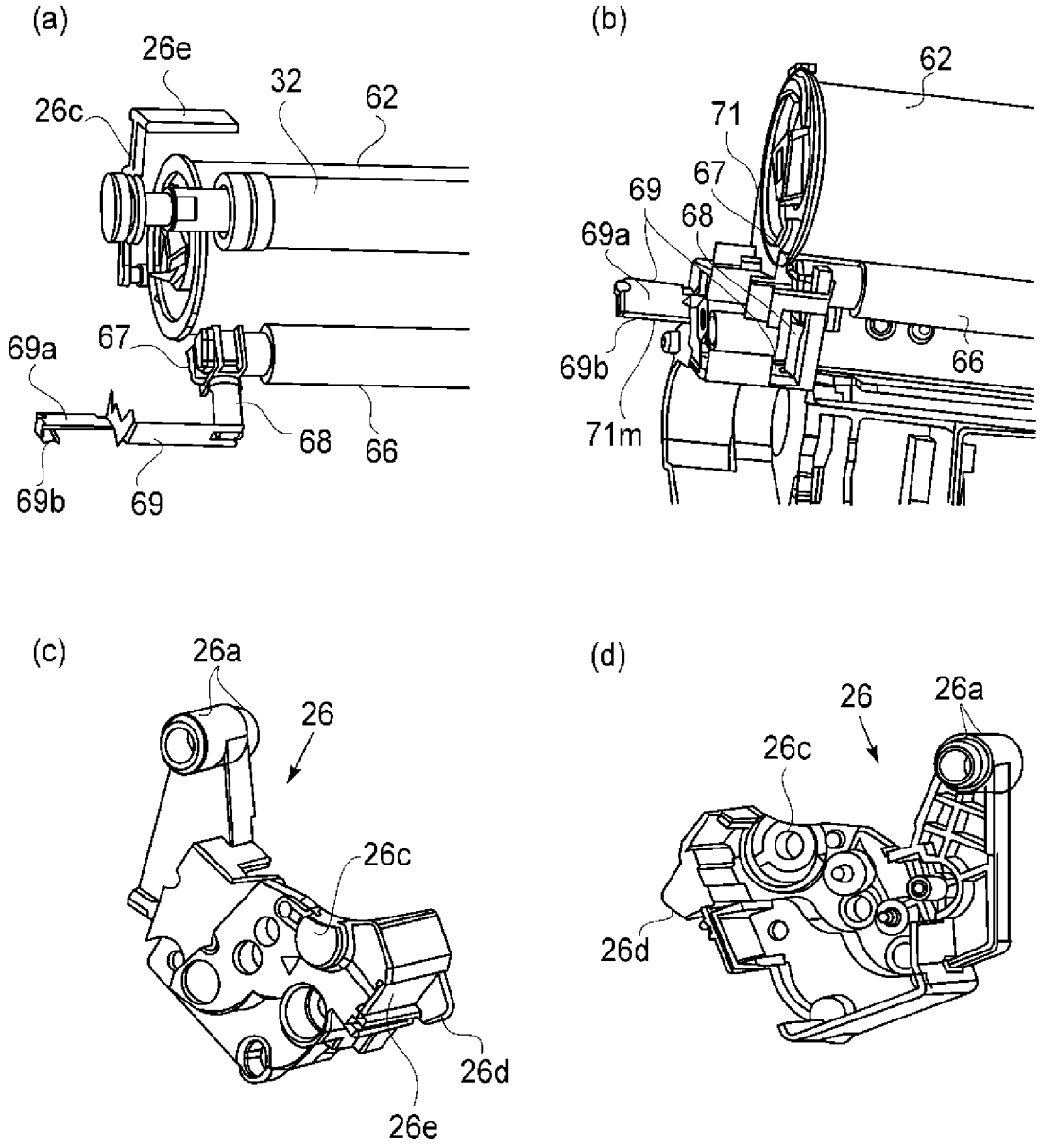

Parts (a) to (d) of FIG. 22 are illustrations of a contact structure of a process cartridge according to the present invention.

Figure 23:
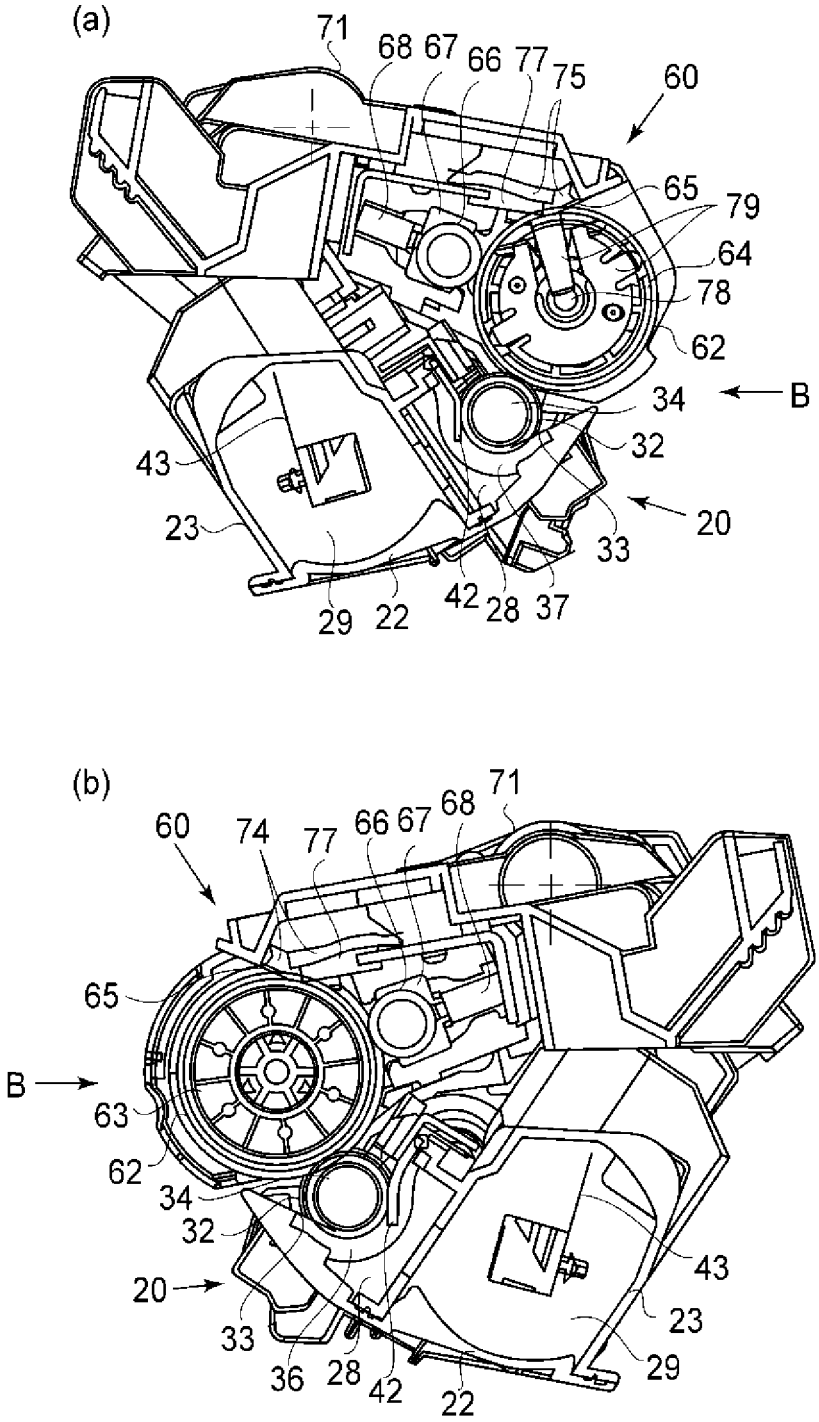

Parts (a) and (b) of FIG. 23 are sectional views of the process cartridge according to the present invention.

Figure 24A:
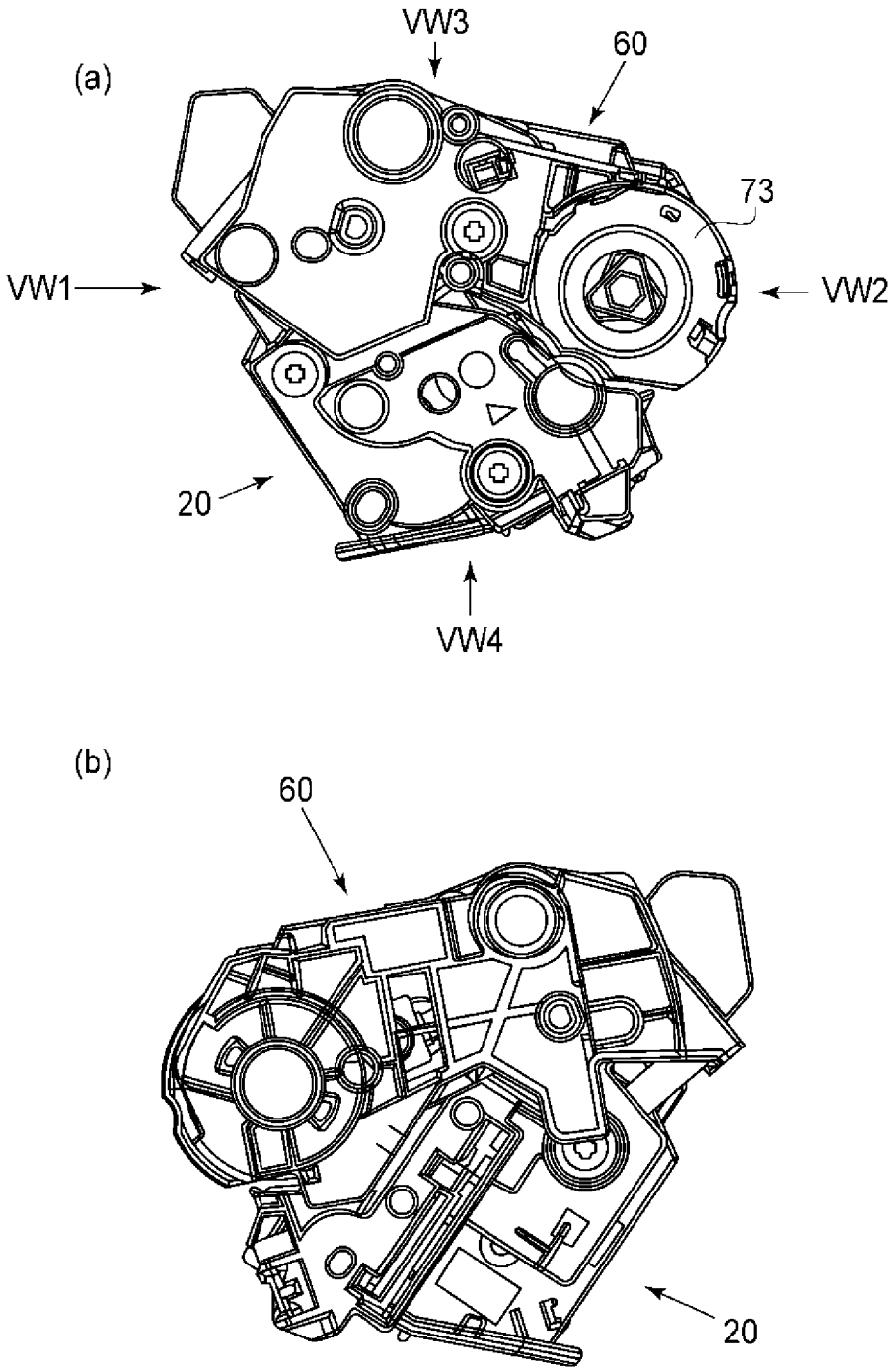
Figure 24B:
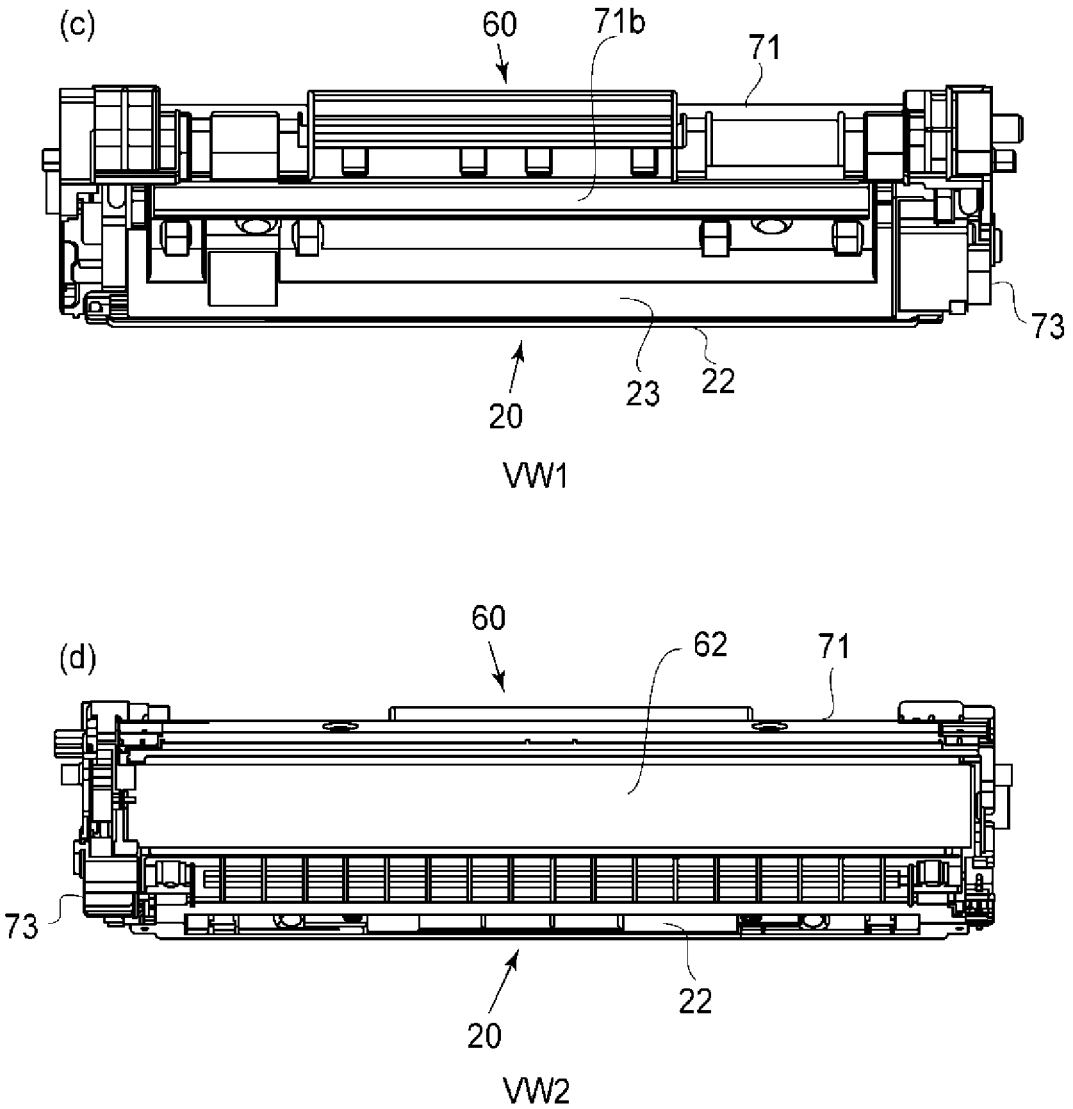
Figure 24C:
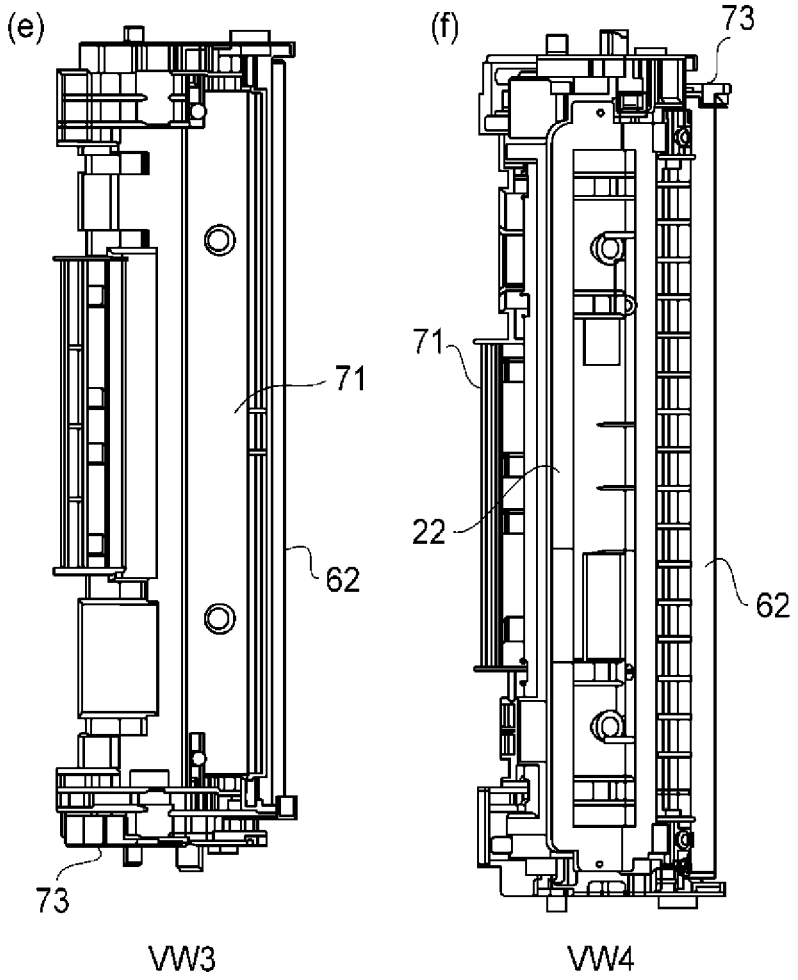

Parts (a) and (b) of FIG. 24A, parts (c) and (d) of FIG. 24B, and parts (e) and (f) of FIG. 24C are schematic views showing an outer appearance of the process cartridge according to the present invention.

Figure 25:
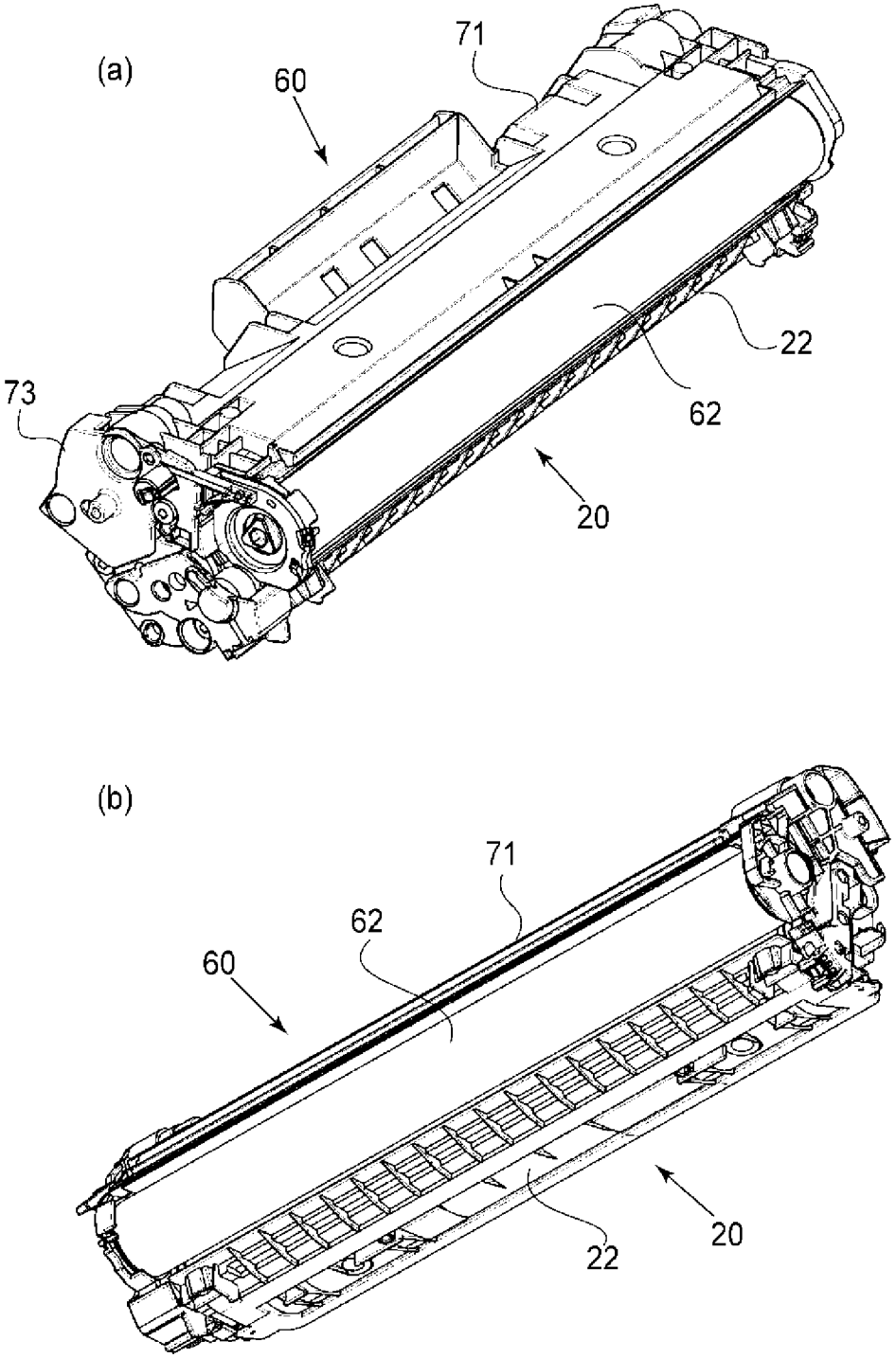

Parts (a) and (b) of FIG. 25 are schematic views showing the outer appearance of the process cartridge according to the present invention.

Figure 26A:
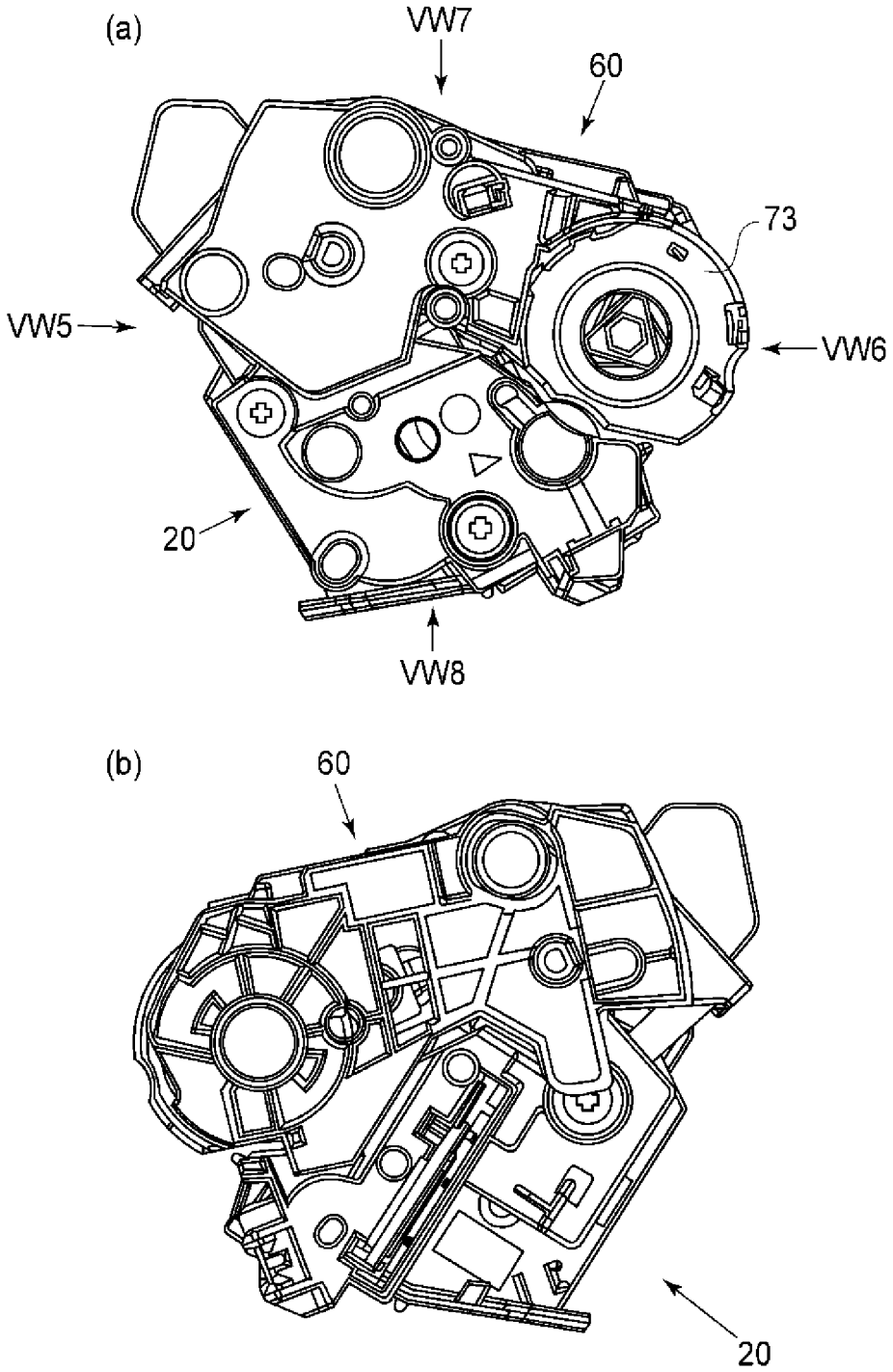
Figure 26B:
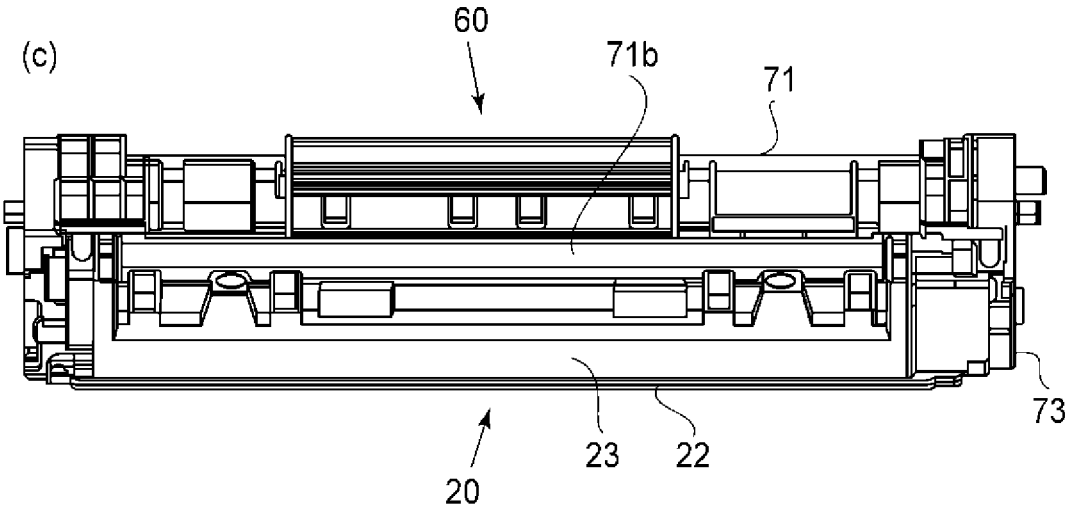
Figure 26B:
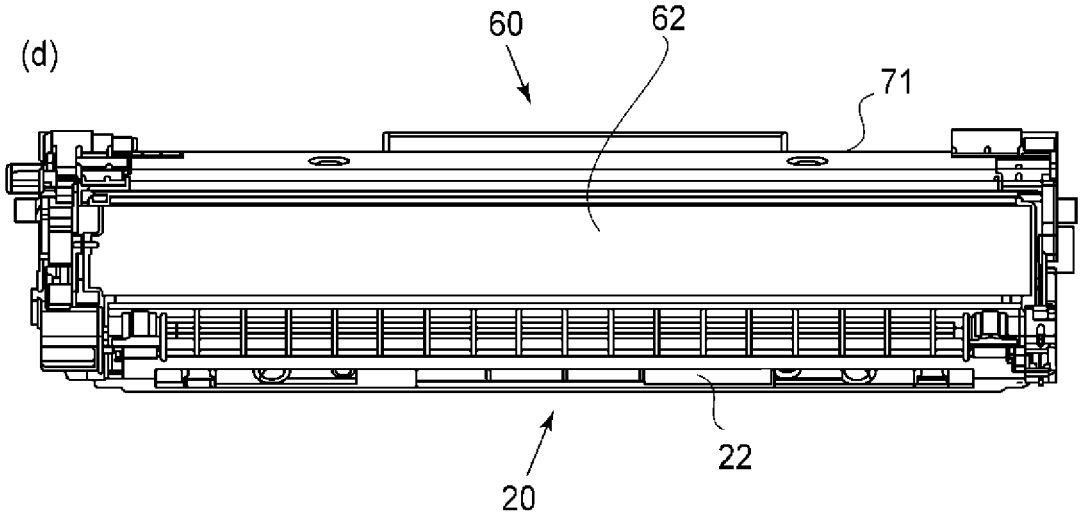
Figure 26C:
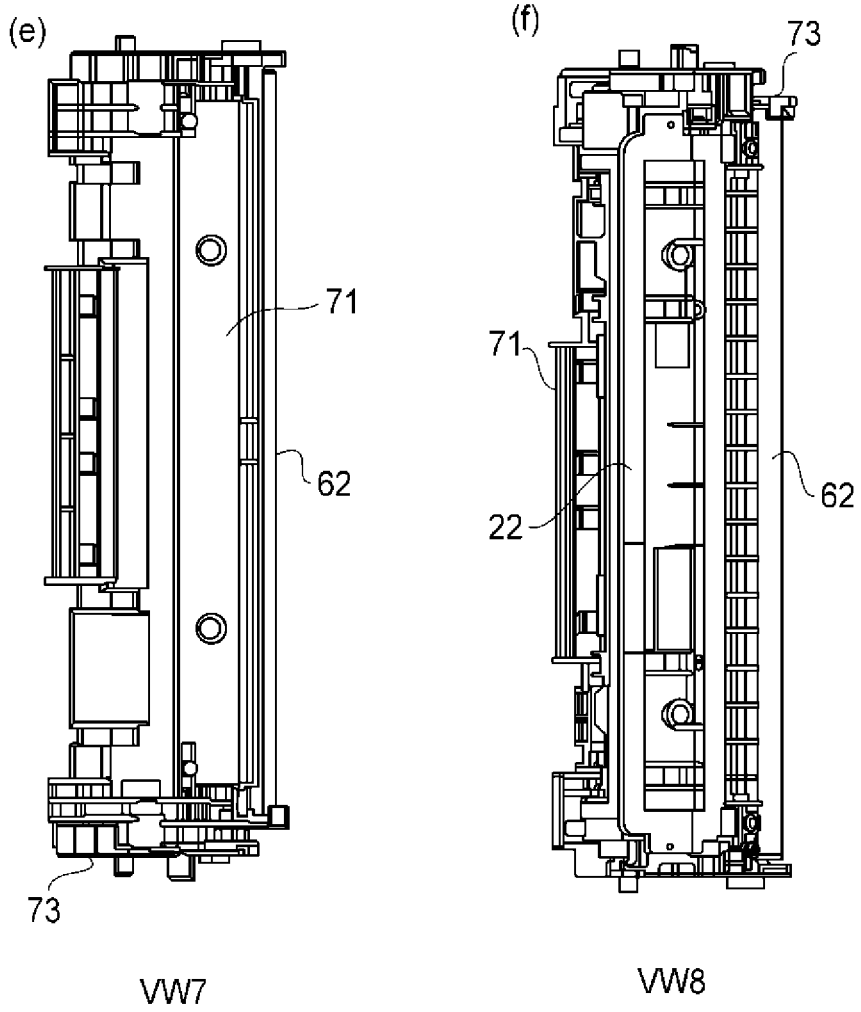

Parts (a) and (b) of FIG. 26A, parts (c) and (d) of FIG. 26B, and parts (e) and (f) of FIG. 26C are schematic views showing the outer appearance of the process cartridge according to the present invention.

Figure 27:
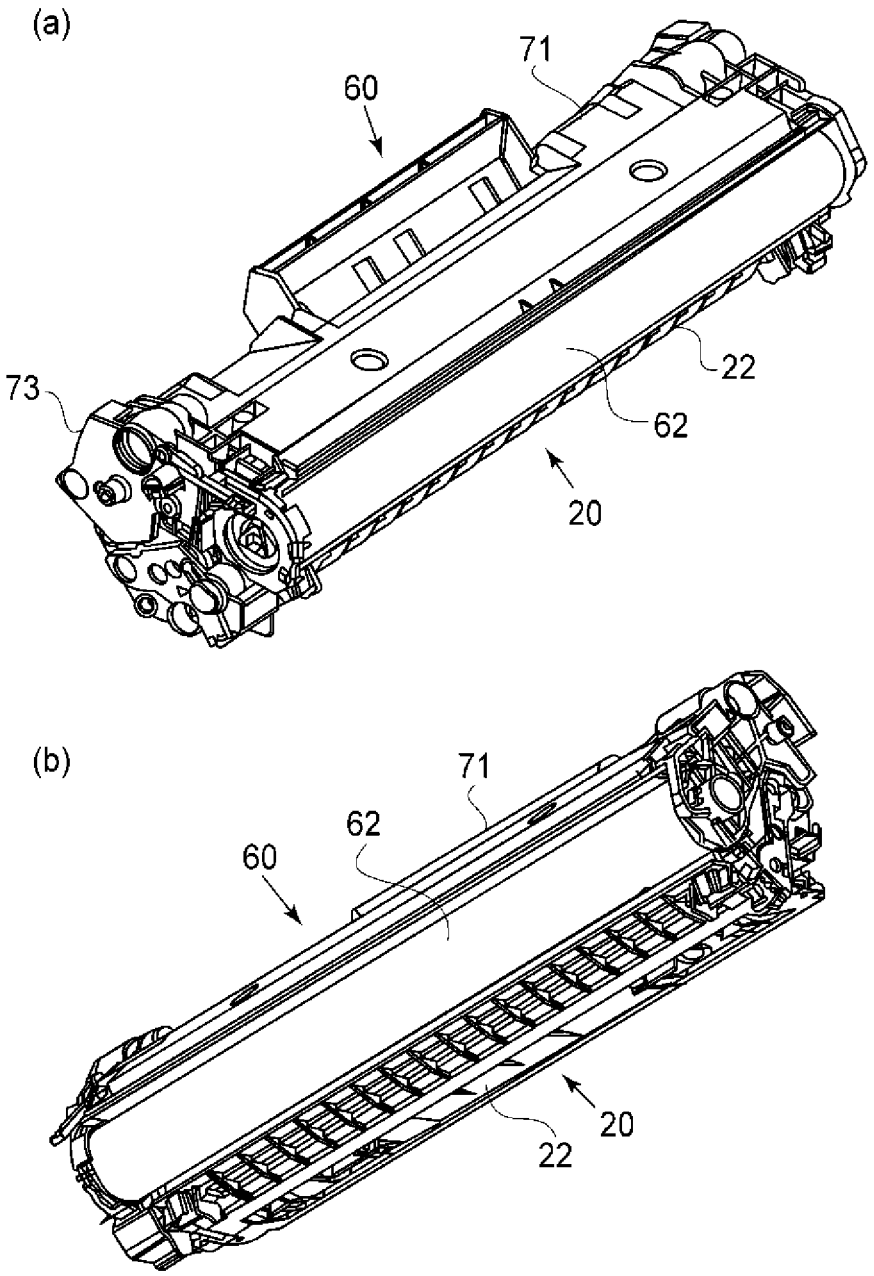

Parts (a) and (b) of FIG. 27 are schematic views showing the outer appearance of the process cartridge according to the present invention.

DESCRIPTION OF THE EMBODIMENTS

Embodiment 1

An embodiment of the present invention will be described in detail with reference to the drawings.

Here, a rotational axis direction of an electrophotographic photosensitive drum is a longitudinal direction. Further, with respect to the longitudinal direction, a side in which the drum receives a driving force from an image forming apparatus main assembly is a driving side, and an opposite side thereof is a non-driving side.

Figure 2:
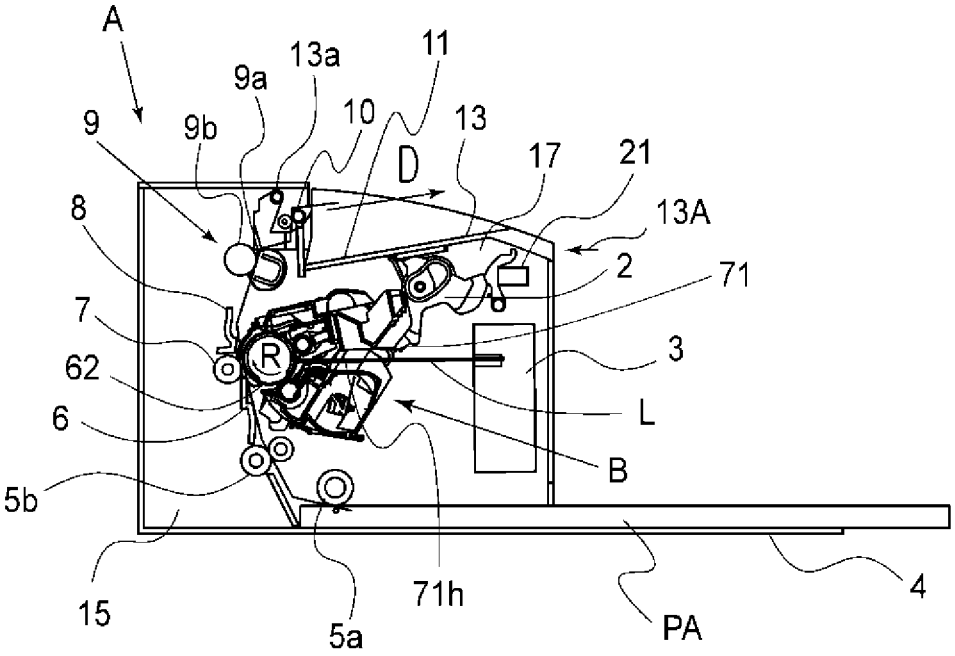
FIG. 2 is a schematic sectional view of an image forming apparatus in the embodiment.
Figure 3:
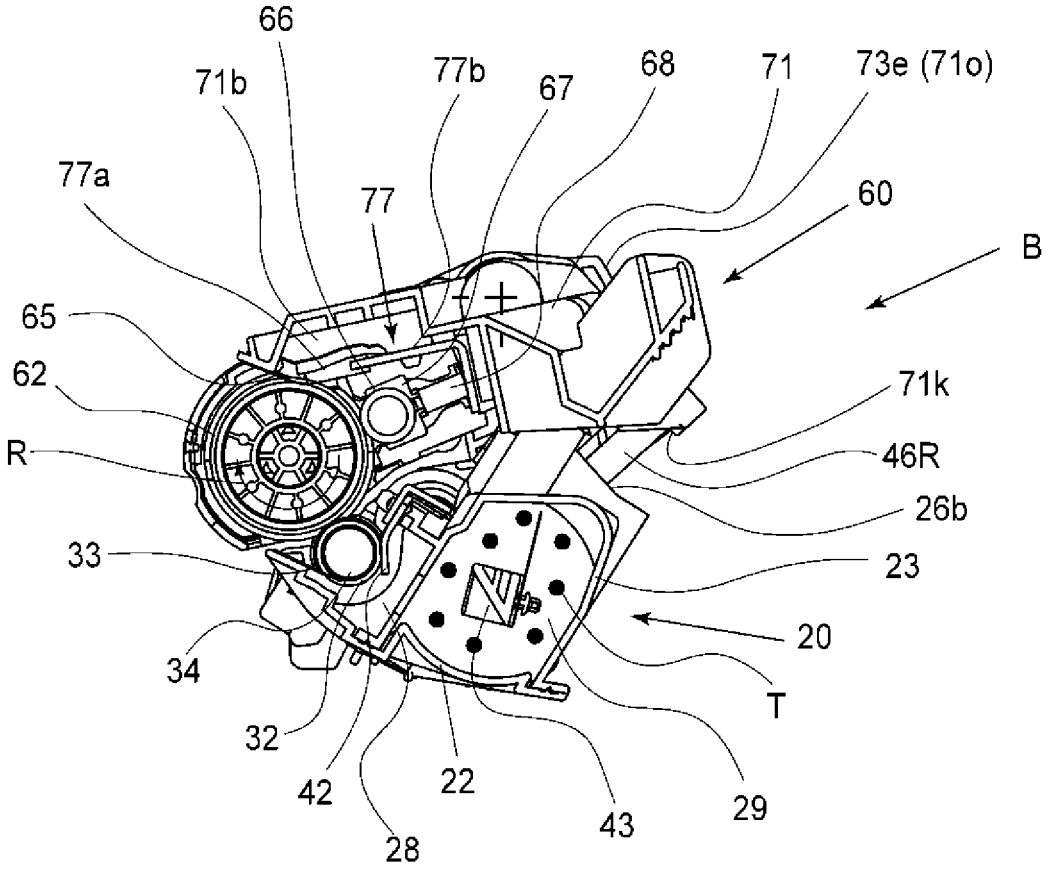
FIG. 3 is a schematic sectional view of the cartridge.

A general structure of the image forming apparatus of a cartridge type in this embodiment and an image forming process will be described using FIGS. 2 and 3. FIG. 2 is a sectional view of the electrophotographic image forming apparatus in this embodiment and shows a state in which a process cartridge B is mounted in an apparatus main assembly (electrophotographic image forming apparatus main assembly) A in this embodiment and in which an image forming operation is capable of being performed. FIG. 3 is a schematic sectional view of the cartridge B. Here, the apparatus main assembly A is a portion obtained by removing the cartridge B from the electrophotographic image forming apparatus.

<General Structure of Electrophotographic Image Forming Apparatus>

The image forming apparatus shown in FIG. 2 is a laser beam printer in which the cartridge B is mountable to and dismountable from the apparatus main assembly A and which uses electrophotographic technology. This printer performs an image forming operation on the basis of electrical image information inputted from an external device (not shown) such as a print server to a controller (not shown) and is capable of printing out a toner image by forming the toner image on a recording material (hereinafter referred to as a sheet material) PA which is an object of image formation. When the cartridge B is mounted at a predetermined mounting portion in the apparatus main assembly A in a predetermined mounting manner, an exposure device (laser scanner unit) 3 for forming a latent image on a photosensitive drum 62 as an image bearing member is provided. Further, below the cartridge B in the apparatus main assembly A, a sheet (feeding) tray 4 in which sheet materials PA are accommodated is provided. The photosensitive drum 62 is an electrophotographic photosensitive member used for electrophotographic image formation.

Further, in the apparatus main assembly A, along a feeding direction D of the sheet material PA, a pick-up roller 5*a*, a feeding roller pair 5*b*, a transfer guide 6, a transfer roller 7, a feeding guide 8, a fixing device 9, a discharging roller pair 10, a discharge tray 11 and the like are successively provided. The fixing device 9 is constituted by a heating roller 9*a* and a pressing roller 9*b*.

<Image Forming Process>

An outline of an image forming process will be described. On the basis of a print start signal, the drum 62 is rotationally driven at a predetermined peripheral speed (process speed) in an arrow R direction. Further, a charging roller (charging member) 66 to which a bias voltage is applied contacts an outer peripheral surface of the drum 62 and electrically charges the outer peripheral surface of the drum 62 uniformly.

The exposure device 3 outputs laser light L depending on image information. The laser light L passes through a laser opening 71*h* provided in a cleaning frame 71, so that the outer peripheral surface of the drum 62 is subjected to scanning exposure. As a result, on the outer peripheral surface of the drum 62, an electrostatic latent image depending on the image information is formed.

On the other hand, as shown in FIG. 3, in a developing unit (developing means) 20 (second unit) as a developing device, a toner T in a toner chamber 29 is stirred and fed by rotation of a feeding member (stirring member) 43, thus being sent to a toner supplying chamber 28. The toner T is carried by a magnetic force of a magnet roller 34 (fixed magnet) on a surface of a developing roller 32. The developing roller 32 is a developer carrying member for carrying a developer (toner) T on a surface thereof in order to develop the latent image formed on the drum 62.

The toner T is regulated in layer thickness on the peripheral surface of the developing roller 32 as the developer carrying member by a developing blade 42 while being triboelectrically charged. The toner T is supplied onto the drum 62 depending on the electrostatic latent image, so that the electrostatic latent image is visualized (developed) as a toner image. The drum 62 is an image bearing member for carrying the latent image and the toner image (developer image) on the surface thereof.

As shown in FIG. 2, in synchronism with output timing of the laser light L by the pick-up roller 5*a* and the feeding roller pair 5*b*, the sheet material PA accommodated in the sheet tray 4 provided at a lower portion of the apparatus main assembly A is fed. Then, the sheet material PA is fed to a transfer position (transfer portion) between the drum 62 and the transfer roller 7 via the transfer guide 6. In this transfer position, the toner image is successively transferred from the drum 62 onto the sheet material PA.

The sheet material PA on which the toner image is transferred is separated from the drum 62 and then is fed to the fixing device 9 along the conveying guide 8. Then, the sheet material PA passes through a nip between the heating roller 9*a* and the pressing roller 9*b* which constitute the fixing device 9. At this nip, a pressure and heat-fixing process is effected, so that the toner image is fixed on the sheet material PA. The sheet material PA on which the toner image is fixed is fed to the discharging roller pair 10 and then is discharged onto the discharge tray 11.

On the other hand, as shown in FIG. 3, the drum 62 after the toner image transfer is, after a residual toner on the outer peripheral surface of the drum 62 is removed by a cleaning blade 77, used again in the image forming process. The residual toner removed from the drum 62 is stored in a residual toner chamber 71*b* of a cleaning unit 60. The cleaning unit 60 is a unit including the drum 62.

In the above, the charging roller 66, the developing roller 32, the transfer blade 7 and the cleaning blade 77 are process means actable on the drum 62.

<General Structure of Cartridge>

Figure 4:
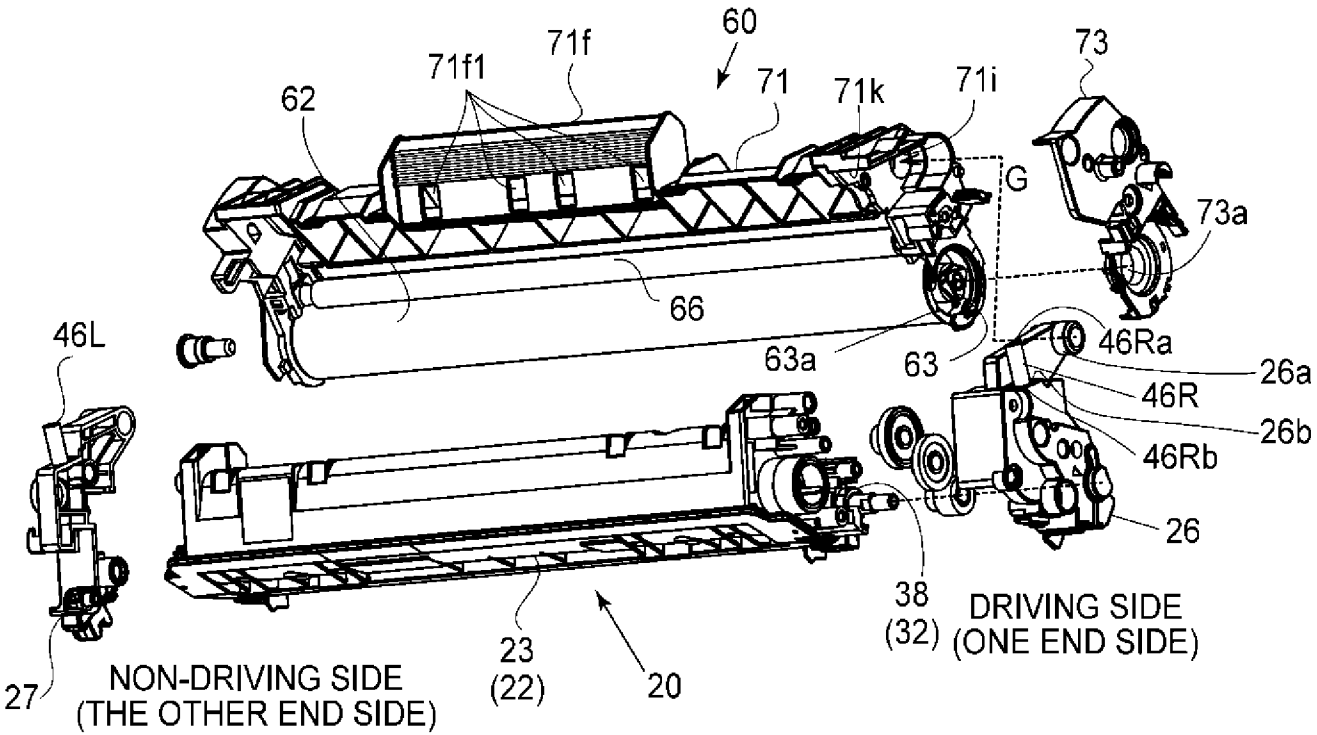
FIG. 4 is a schematic exploded perspective view of the cartridge.

A general structure of the cartridge B will be described using FIGS. 3, 23, 4, 5, 24A, 24B, 24C, 25, 26A, 26B, 26C and 27. FIGS. 3 and 23 are sectional views of the cartridge B, and FIGS. 4 and 5 are exploded schematic perspective views for illustrating a structure of the cartridge B. FIGS. 24A, 24B, 24C, 26A, 26B and 26C are schematic views showing an outer appearance of the cartridge B, and FIGS. 25 and 27 are perspective views showing the outer appearance of the cartridge B.

Part (a) of FIG. 24A is a side view of the cartridge B as seen from a driving side. Part (b) of FIG. 24A is a side view of the cartridge B as seen from a non-driving side. Part (c) of FIG. 24B is a side view of the cartridge B as seen in a direction VW1 shown in part (a) of FIG. 24A. Part (d) of FIG. 24B is a side view of the cartridge B as seen in a direction VW2 shown in part (a) of FIG. 24A. Part (e) of FIG. 24C is a side view of the cartridge B as seen in a direction DW3 shown in part (a) of FIG. 24A. Part (f) of FIG. 24C is a side view of the cartridge B as seen in a direction DW4 shown in part (a) of FIG. 24. Parts (a) and (b) of FIG. 25 are perspective views of the cartridge B.

Part (a) of FIG. 26A is a side view of the cartridge B as seen from a driving side. Part (b) of FIG. 26A is a side view of the cartridge B as seen from a non-driving side. Part (c) of FIG. 26B is a side view of the cartridge B as seen in a direction VW5 shown in part (a) of FIG. 26A. Part (d) of FIG. 26B is a side view of the cartridge B as seen in a direction VW6 shown in part (a) of FIG. 26A. Part (e) of FIG. 26C is a side view of the cartridge B as seen in a direction DW7 shown in part (a) of FIG. 26A. Part (f) of FIG. 26C is a side view of the cartridge B as seen in a direction DW8 shown in part (a) of FIG. 26. Parts (a) and (b) of FIG. 27 are perspective views of the cartridge B.

The cartridge B includes the cleaning unit 60 (photosensitive member holding unit, drum holding unit, image bearing member holding unit, first unit and the developing unit 20 (developer carrying member holding unit, second unit).

In general, the process cartridge is prepared by integrally assembling the electrophotographic photosensitive drum and at least one of the process means actable on the photosensitive member, into a cartridge which is mountable to and dismounted from (detachably mounted on) the main assembly (apparatus main assembly) of the electrophotographic image forming apparatus. As an example of the process means, a charging means, a developing means and a cleaning means are cited.

As shown in FIG. 3, the cleaning unit 60 includes the drum 62, the charging roller 66, the cleaning member 77 and the cleaning frame 71 supporting these members. The drum 62 includes a driving side drum flange 63 provided on the driving side (on one end side of the drum 62 with respect to the longitudinal direction), and the drum flange 63 is rotatably supported by a hole 73*a* of a drum bearing 73 on the driving side. In a broad sense, the drum bearing 73 and the cleaning frame 71 can be collectively called a cleaning frame. Here, as shown in FIG. 13, the driving side drum flange 63 is provided with through holes 63*a*.

Figure 5A:
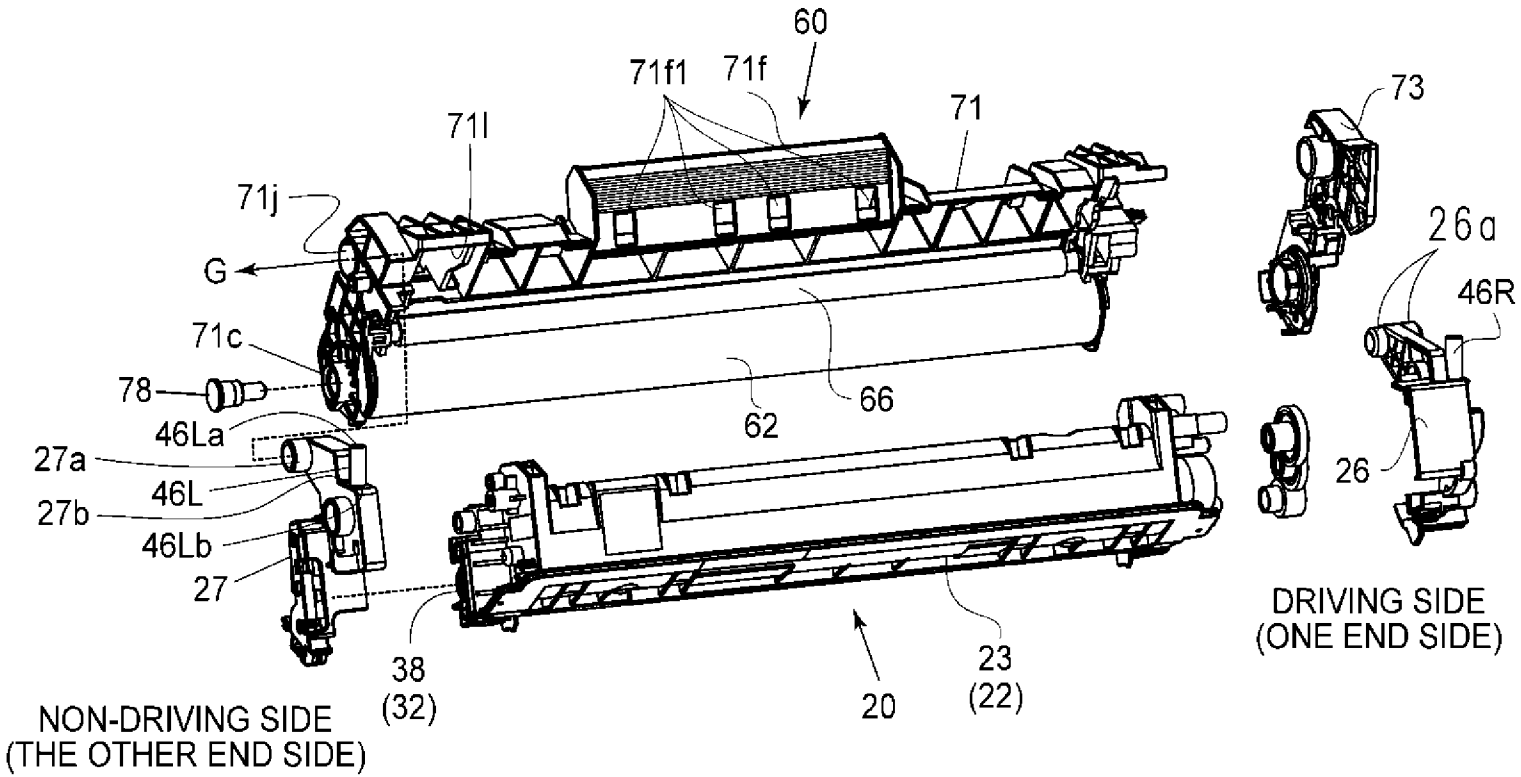
FIG. 5A is a schematic exploded perspective view of the cartridge.

On the non-driving side (on the other end side of the drum 52 with respect to the longitudinal direction), as shown in FIGS. 5A and 13, a constitution in which by a drum shaft 78 press-fitted in a hole 71*a* of the cleaning frame 71, a hole (not shown) of a non-driving side drum flange 64 is rotatably supported is employed. The driving side drum flange 63 and the non-driving side drum flange 64 are portions-to-be-supported which are rotatably supported by the bearing portions. Incidentally, the drum 62 and the drum shaft 78 are electrically conductible to each other via an electrode member 79 shown in part (a) of FIG. 23. When the cartridge B is mounted in the apparatus main assembly A, the drum shaft 78 contacts a drum contact potion 84 of the apparatus main assembly A shown in part (b) of FIG. 21.

In the cleaning unit 60, the charging roller 66 and the cleaning member 77 are disposed in contact with the outer peripheral surface of the drum 62. The cleaning member 77 includes a rubber blade 77*a* which is a blade-shaped elastic member formed of a rubber as an elastic material, and a supporting member 77*b* for supporting the rubber blade 77*a*. The rubber blade 77*a* is contacted to the drum 62 counter-directionally to a rotational direction R of the drum 62. That is, the rubber blade 77*a* is contacted to the drum 62 so that a free end portion thereof is directed upward with respect to the rotational direction R of the drum 62.

As shown in FIG. 3, the residual toner removed from the surface of the drum 62 by the cleaning member 77 is accumulated in a residual toner chamber 71*b* formed by the cleaning frame 71 and the cleaning member 77.

Further, as shown in FIG. 3, a receptor sheet 65 for preventing leakage of the residual toner from the cleaning frame 71 is provided at an edge portion of the cleaning frame 71 so as to contact the drum 62. Further, as shown in FIG. 14, end portion sealing members 74 and 75 for preventing leakage of the toner from both end portions of the cleaning frame 71 are provided at the end portions of the cleaning frame 71, respectively.

The charging roller 66 is rotatably mounted in the cleaning unit 60 via a charging roller bearing 67 in each of the end portions with respect to a longitudinal direction of the cleaning frame 71. Incidentally, the longitudinal direction of the cleaning frame 71 (the longitudinal direction of the cartridge B) is substantially parallel to a direction (axial direction) in which a rotational axis of the drum 62 extends.

For that reason, in the following, in the case where the longitudinal direction is simply referred to or the axial direction is simply referred to unless otherwise specified, the longitudinal direction or the axial direction is intended to the axial direction of the drum 62.

The charging roller 66 is press-contacted to the drum 62 by pressing the charging roller bearing 67 toward the drum 62 by an urging member 68. The charging roller 66 is rotated by the rotation of the drum 62.

As shown in part (a) of FIG. 21, in the apparatus main assembly A, a charging contact portion 82 for applying a voltage to the charging roller 66 is provided, and the voltage is applied by contact of the charging contact portion 82 with a contact portion 69*a* of an electrode member 69 provided on the cleaning frame 71. As shown in parts (a) and (b) of FIG. 22, the voltage is supplied to the charging roller 66 through the electrode member 69, the urging member 68 and the charging roller bearing 67. The electrode member 69 is press-fitted into and fixed to a portion-to-be-press-fitted 71*m* of the cleaning frame 71 by a press-fitting portion 69*b*.

As shown in FIG. 3, the developing unit 20 includes the developing roller 32, the developing container 23 for supporting the developing roller 32, a developing blade 42, and the like. As shown in FIGS. 4 and 5A, the developing roller 32 is rotatably mounted to the developing container 23 by bearing members 26 and 27 provided at both ends thereof. Further, the bearing member 26 shown in parts (c) and (d) of FIG. 22 is provided with an electroconductive portion 26*c* for supplying a voltage to the developing roller 32, and the voltage is applied by contact of a contact portion 26*e* with a developing contact portion 83 of the apparatus main assembly A shown in part (a) of FIG. 21.

Further, inside the developing roller 32, a magnet roller 34 is provided. In the developing unit 20, the developing blade 42 for regulating a toner layer on the developing roller 32 is disposed. As shown in FIGS. 17 and 18, a gap holding member 38 is mounted to each of end portions of the developing roller 32, and by contact of the gap holding member 38 with the drum 62, the developing roller 32 is held with a predetermined minute gap with the drum 62.

Further, as shown in FIGS. 3 and 16, a blowing prevention sheet 33 for preventing leakage of the toner from the developing unit 20 is provided in contact with the developing roller 32 at an edge portion of a bottom member 22. Further, as shown in FIG. 15, at both end portions of the developing container 23, in order to prevent toner leakage from the end portions, end portion sealing members 36 and 37 are provided so as to contact the developing roller 32. Further, regulating members 40 and 41 for regulating (preventing) flow-out of the toner on the developing roller 32 to an outside with respect to the longitudinal direction and for collecting the toner deposited on the gap holding members 38 in contact with the developing roller 32 and the gap holding members 38 and are mounted on the developing blade 42.

Further, in the toner chamber 29 formed by the developing container 23 and the bottom member 22, a feeding member 43 is provided. The feeding member 43 not only stirs the toner accommodated in the toner chamber 29 but also feeds the toner to the toner supplying chamber 28.

As shown in FIG. 16, on the driving side of the developing unit 20, a developing gear 47, idler gears 48 and 49 and a stirring gear 50 are provided in series, and the stirring (feeding) member 43 is driven in interrelation with drive of the developing roller 32. Further, the developing roller 32 is supported by the bearing member 26 on the driving side. Further, as shown in FIG. 17, on the non-driving side, the bearing member 27 and a supporting member 35 for supporting the developing roller 32 on the non-driving side and for fixedly supporting a phase of the magnet roller 34 are provided. Incidentally, the bearing members 26 and 27 are fixed to the developing container 23 by a fixing member 86 such as a screw.

As shown in FIGS. 4 and 5, the cartridge B is constituted by combining the cleaning unit 60 and the developing unit 20. When the developing unit 20 and the cleaning unit 60 are connected with each other, the following operation is performed. First, a center of a first developing unit supporting boss 26*a* of the bearing member 26 relative to a first hanging hole 71*i* on the driving side of the cleaning frame 71 and a center of a second developing unit supporting boss 27*a* of the bearing member 27 relative to a second hanging hole 71*j* on the non-driving side of the cleaning frame 71 are aligned with each other.

Specifically, by moving the developing unit 20 in an arrow G direction, the first and second developing unit supporting bosses 26*a* and 27*a* are engaged with the first and second hanging holes 71*i* and 71*j*, respectively. As a result, the developing unit 20 is movably connected with the cleaning unit 60. More specifically, the developing unit 20 is rotatably (rotationally movably) connected with the cleaning unit 60. Thereafter, the cartridge B is constituted by assembling the drum bearing 73 with the cleaning unit 60 as shown in FIG. 18.

Incidentally, the drum bearing 73 is fixed to the cleaning frame 71 by the fixing member 86 such as the screw. Further, the drum bearing 73 is provided with an injection opening 73*h* through which an adhesive such as limonene is injected, and the cleaning frame 71 is provided with a flow path 71*n* along which the adhesive flows, so that the cleaning frame 71 and the drum bearing 73 are adhesively fixed to each other.

Figure 5B:
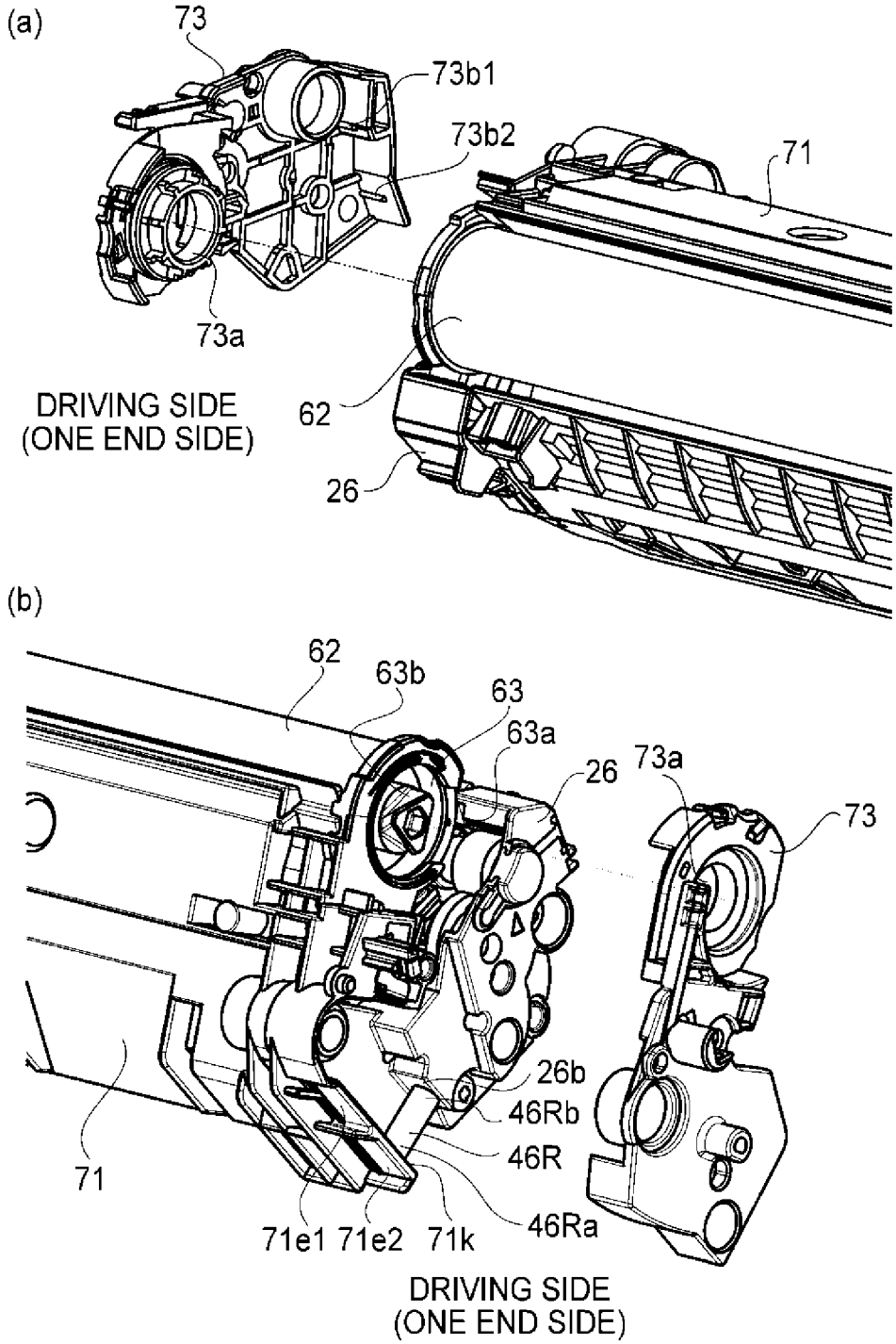
FIG. 5B is a schematic exploded perspective view of the cartridge.

Here, as shown in part (a) of FIG. 5B, the drum bearing 73 is provided with projected portions 73*b*1 and 73*b*2. When the drum bearing 73 is assembled with the cleaning unit 60, as shown in part (b) of FIG. 58, the cleaning frame 71 is provided with receiving surfaces 71*e*1 and 71*e*2 at positions opposing the projected portions 73*b*1 and 73*b*2, respectively. In a state in which assembling of the cartridge B is completed, the projected portions 73*b*1 and 73*b*2 contact the receiving surfaces 71*e*1 and 73*e*2, respectively, so that deformation of the cleaning frame 71 is suppressed. This will be described specifically later.

As shown in FIG. 4 and part (b) of FIG. 5B, a first end portion 46Rb of a driving side urging member 46R is fixed to a surface 26*b* of the bearing member 26, and a second end portion 46Ra contacts a surface 71*k* which is a part of the cleaning unit 60. Further, as shown in FIG. 5A, a first end portion 46Lb of a non-driving side urging member 46L is fixed to a surface 27*b* of the bearing member 27, and a second end portion 46La contacts a surface 71*l* which is a part of the cleaning unit 60.

In this embodiment, each of the driving side urging member 46R and the non-driving side urging member 46F is formed with a compression spring. The developing unit 20 is urged toward the cleaning unit 60 by the driving side urging member 46R and the non-driving side urging member 46L with an urging force of these springs, so that the developing roller 32 is constituted so as to be pressed toward the drum 62 with reliability.

Further, by the gap holding member 38 provided at each of the end portions of the developing roller 32, the developing roller 32 is held with a predetermined gap from the drum 62. Further, as shown in FIG. 5B described above, as regards the cleaning frame 71 and the drum bearing 73 which are positioned relative to each other, the projected portions 73*b*1 and 73*b*2 contact the receiving surfaces 71*e*1 and 71*e*2, respectively, and therefore, deformation of these members can be prevented even when the spring forces act on these members.

As shown in FIG. 19, on the cartridge B, a protective member 80 is to mounted so as to cover the drum 62. The protective member 80 is provided for the purpose of preventing damage and contamination on the drum 62, and is removed (dismounted) from the cartridge B when the cartridge B is mounted in the image forming apparatus A. The protective member 80 is provided with four claw portions 80*a* for fixing the protective member 80 to the cartridge B and two projected portions 80*b* for spacing the drum 62 and the developing roller 32 from each other.

<Mounting of Cartridge>

In this embodiment, the apparatus main assembly A includes a portion containing the discharge tray 11 on an upper side thereof, and this portion is rotatably connected as an openable door 13 with the apparatus main assembly A so as to be operable and closable relative to the apparatus main assembly A via a hinge shaft 13*a*. The openable door 13 is capable of moving between a closed position 13A of FIG. 2 and an open position 13B of FIG. 6. An opening and closing operation of the openable door 13 is performed by a user (operator), and an opening 17 provided on the upper surface side of the apparatus main assembly A is largely opened by opening and rotating the openable door 13 to the open position 13B. The opening 17 which is opened is used as a cartridge inserting opening, so that the cartridge B can be detachably (dismountably) mounted in a cartridge mounting portion of the apparatus main assembly A.

Then, after the cartridge B is mounted in the apparatus main assembly A, the openable door 13 is closed and rotated to the closed position 13A. As a result, the opening 17 is closed. In a state in which the cartridge B is mounted in the mounting portion of the apparatus main assembly A in a predetermined manner and the opening 17 is closed by the openable door 13, the image forming apparatus is capable of performing the image forming operation.

Part (a) of FIG. 6 is a schematic view of a driving side guiding portion of the apparatus main assembly A for illustrating the mounting of the cartridge B, and part (b) of FIG. 6 is a schematic view of a non-driving side guiding portion of the apparatus main assembly A for illustrating the mounting of the cartridge B. Part (a) of FIG. 7 is a schematic view of the apparatus main assembly A on the driving side for illustrating positioning of the cartridge B, and part (b) of FIG. 7 is a schematic view of the apparatus main assembly A on the non-driving side for illustrating positioning of the cartridge B. Part (a) of FIG. 8 is a schematic view of the driving side guiding portion of the apparatus main assembly A for illustrating the mounting of the cartridge B, and part (b) of FIG. 8 is a schematic view of the driving side guiding portion of the apparatus main assembly A for illustrating the mounting of the cartridge B.

Figure 9A:
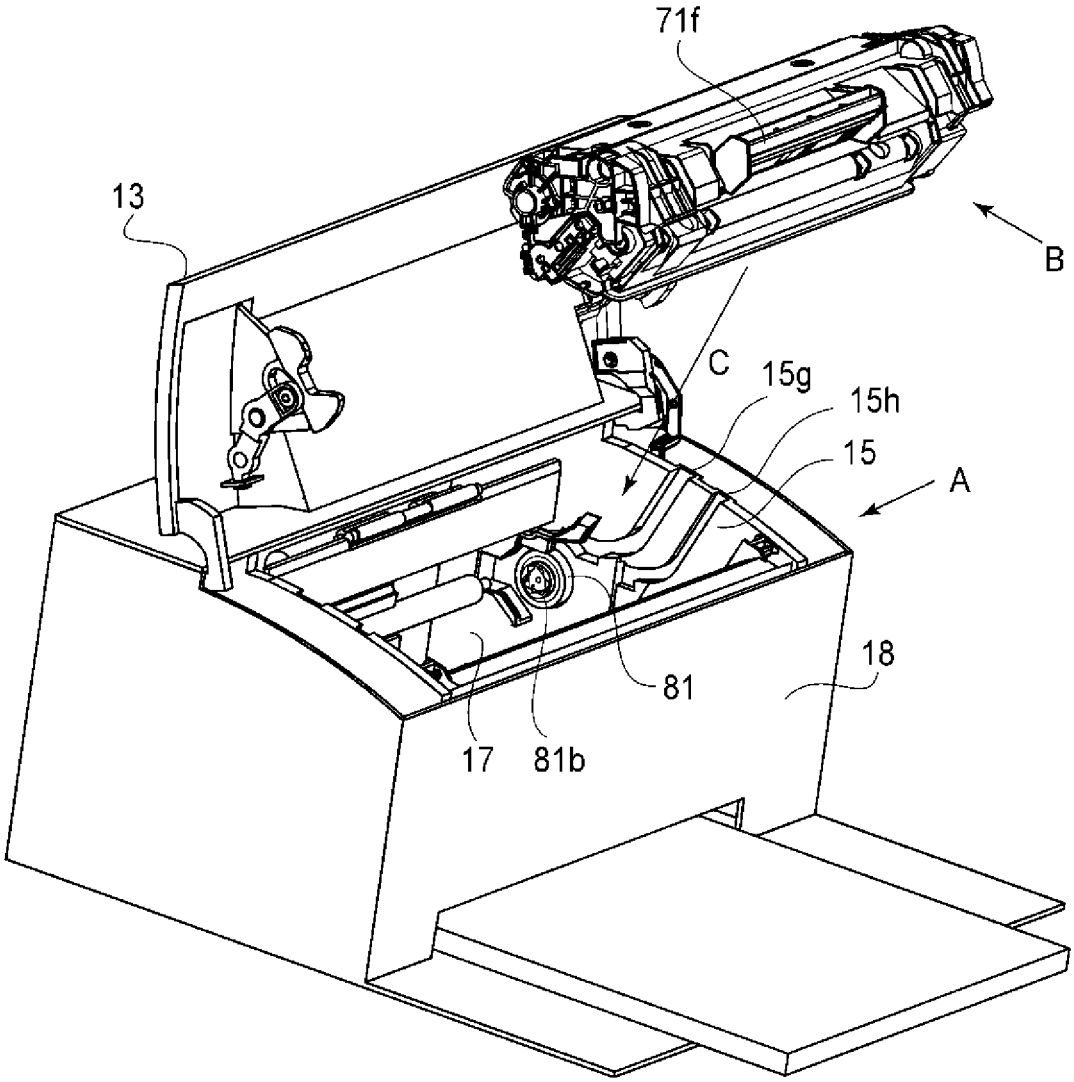
Figure 9B:
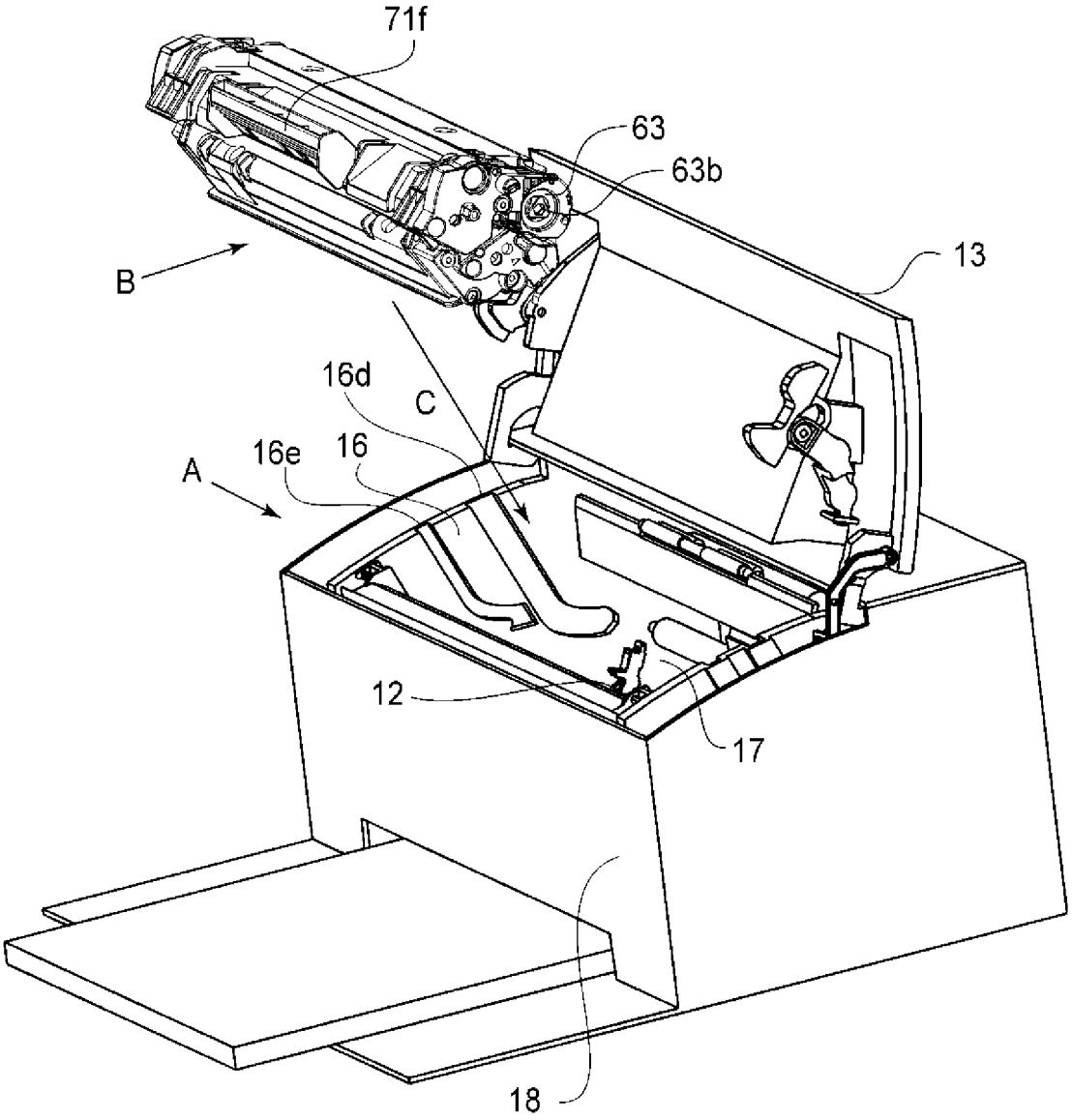

As shown in parts (a) and (b) of FIG. 6 and FIGS. 9A and 9B, a side plate 15 of the apparatus main assembly A on the driving side includes a first guiding rail 15*g* and a second guiding rail 15*h* as guides. Further, a side plate 16 of the apparatus main assembly A on the non-driving side includes a third guiding rail 16*d* and a fourth guiding rail 16*e*. Further, the drum bearing 73 provided on the driving side of the cartridge B includes a portion-to-be-guided 73*g* and a portion-to-be-rotation-prevented 73*c*.

Incidentally, a mounting direction of the cartridge B is a direction (of an arrow C) substantially perpendicular to an axis of the drum 62. Further, with respect to the longitudinal direction of the cleaning frame 71, a portion-to-be-positioned 71*d* and a portion-to-be-rotation-prevented 71*g*.

When the cartridge B is mounted through the opening 17 of the apparatus main assembly A, the portion-to-be-guided 73*g* and the portion-to-be-rotation-prevented 73*c* of the cartridge B on the driving side are guided by the first guiding rail 15*g* and the second guiding rail 15*h* of the apparatus main assembly A. On the non-driving side of the cartridge B, the portion-to-be-positioned 71*d* and the portion-to-be-rotation-prevented 71*g* are guided by the third guiding rail 16*d* and the fourth guiding rail 16*e*. As a result, the cartridge B is mounted in the apparatus main assembly A.

Then, a closing state of the openable door 13 will be described. As shown in parts (a) and (b) of FIG. 6 and parts (a) and (b) of FIG. 7, the side plate 15 on the driving side includes a first positioning portion 15*a*, a second (lower) positioning portion 15*b* and a rotation preventing portion 15*c* which are positioning portions. Further, the side plate 16 on the non-driving side includes a positioning portion 16*a* and a rotation preventing portion 16*c*. The drum bearing 73 of the cartridge B includes a portion-to-be-positioned (first portion-to-be-positioned, first projection, first projected portion) 73*d* and a lower portion-to-be-positioned (second portion-to-be-positioned, second projection, second projected portion) 73*f*.

Further, cartridge urging members 1 and 2 are rotatably mounted by a both end portions of the openable door 13 with respect to the longitudinal direction. Cartridge urging springs 19 and 21 are mounted at both end portions of a front plate 18 of the apparatus main assembly A with respect to the longitudinal direction. The drum bearing 73 includes a portion-to-be-urged 73*e* as an urging force receiving portion, and the cleaning frame 71 includes a portion-to-be-urged 710 on the non-driving side (FIG. 3). By closing the openable door 13, the portions-to-be-urged 73*e* and 710 of the cartridge B are urged by the cartridge urging members 1 and 2 urged by the cartridge urging springs 19 and 21 of the apparatus main assembly A (FIG. 7).

As a result, on the driving side, the portion-to-be-positioned 73*d*, the lower portion-to-be-positioned 73*f* and the portion-to-be-rotation-prevented 73*c* of the cartridge B contact the positioning portion 15*a*, the lower positioning portion 15*b* and the rotation preventing portion 15*c*, respectively, of the apparatus main assembly A. Consequently, the cartridge B and the drum 62 are positioned on the driving side. Further, on the non-driving side, the portion-to-be-positioned 71*d* and the portion-to-be-rotation-prevented 71*g* of the cartridge B contact the positioning portion 16*a* and the rotation preventing portion 16*c*, respectively, of the apparatus main assembly A. Consequently, the cartridge B and the drum 62 are positioned.

Incidentally, the portions-to-be-rotation-prevented 73*c* and 71*g* on the driving side and the non-driving side, respectively are D-shaped projections obtained by cutting a cylinder linearly as shown in parts (a) and (b) of FIG. 8 and have flat surface portions 73*c*1 and 71*g*1, respectively. When the cartridge B is mounted, the flat surface portions 73*c*1 and 73*g*1 are caught by retaining portions 15*f* and 16*f*, respectively of the apparatus main assembly A, so that clicking feeling such that the mounting of the cartridge B is completed can be transmitted to the user.

When the cartridge B is mounted in the apparatus main assembly A, in order to improve usability of a mounting operation, as shown in FIGS. 4 and 5A, the cartridge B is provided with a grip portion 71*f* The grip portion 71*f* is provided with a plurality of holes 71*f*1. As shown in FIG. 11, during an operation in a state in which the cartridge B is mounted in the apparatus main assembly A (during the image forming operation of the image forming apparatus), inside air passes through the holes 71*f*1 (in an arrow H direction), so that temperature rise of the cartridge B can be efficiently suppressed.

<Driving Force Receiving Structure of Cartridge.

Figure 9C:
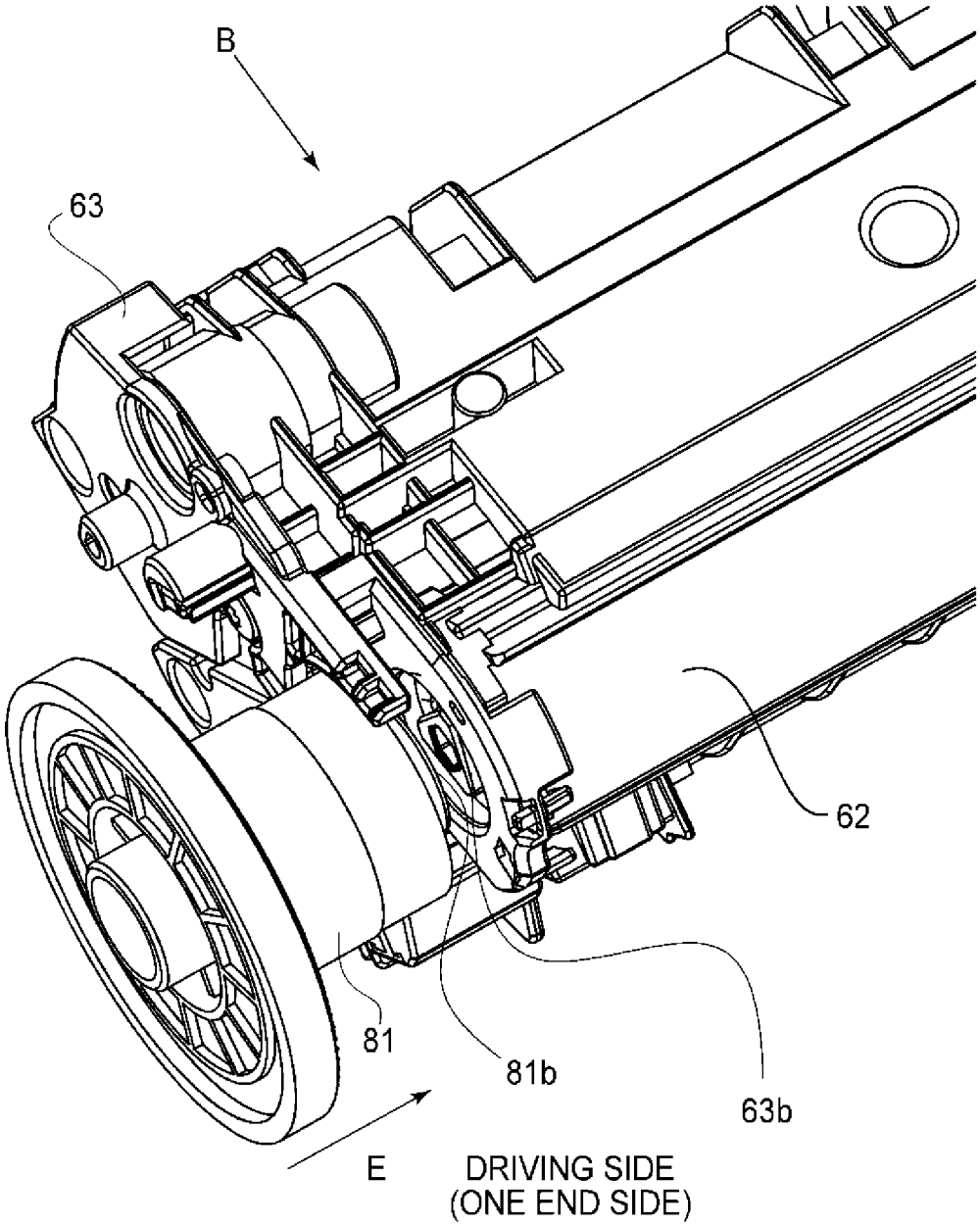
Figure 9D:
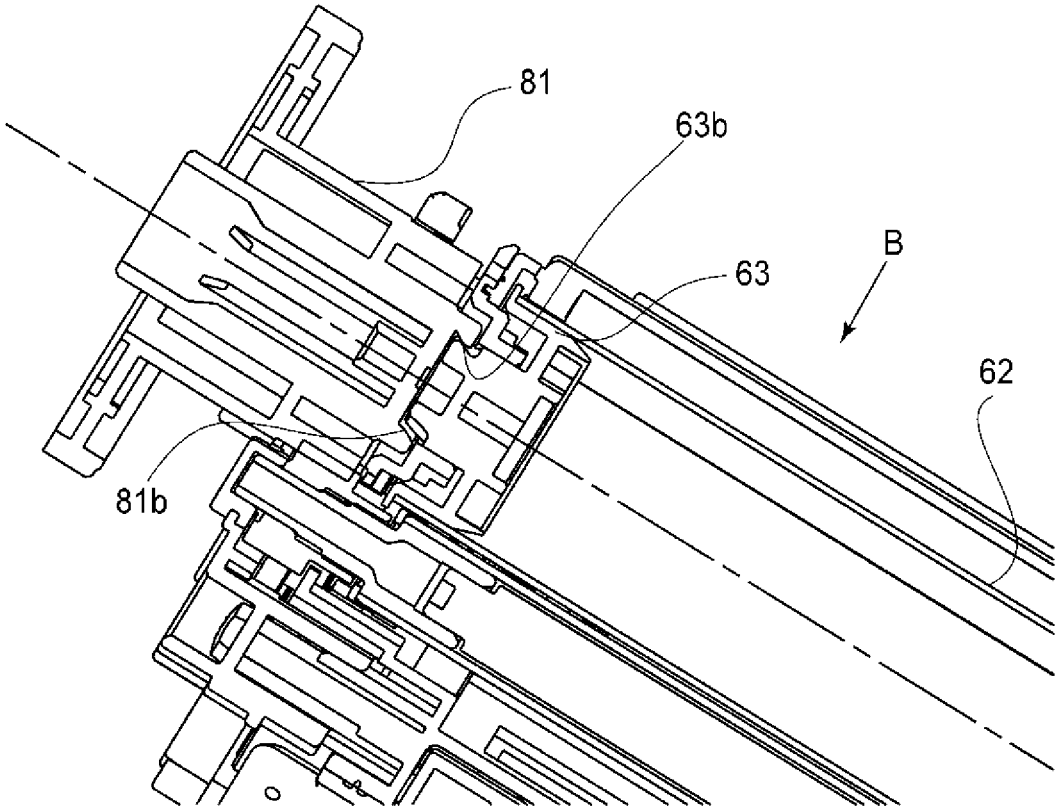

Next, a structure in which the cartridge B receives a driving force from the apparatus main assembly A will be described using FIGS. 9A to 9D. FIG. 9A is a schematic view showing a structure of the apparatus main assembly A on the driving side, and FIG. 9B is a schematic view showing a structure of the apparatus main assembly A on the non-driving side. FIG. 9C is a schematic view showing a state before the apparatus main assembly A and a driving portion of the cartridge B are engaged with each other, and FIG. 9D is a schematic view having a state in which the apparatus main assembly A and the driving portion of the cartridge B are engaged with each other.

As shown in FIG. 9A, the apparatus main assembly A is provided with a drive (driving force) transmitting member 81 for receiving the driving force from a driving source (not shown) of the apparatus main assembly A and for transmitting the driving force to the cartridge B is provided. Further, as shown in FIG. 9B, on the driving side of the cartridge B, the driving side drum flange 63 is provided with a drive (driving force) receiving portion 63*c* for receiving the driving force in engagement with the drive transmitting member 81.

When the cartridge B is mounted in the apparatus main assembly A and the openable door 13 is closed and then a main switch of the apparatus main assembly A is turned on, the drive transmitting member 81 is moved in an arrow E direction while being rotated. Then, as shown in FIG. 9D, a drive transmitting portion 81*b* of the drive transmitting member 81 and the drive receiving portion 63*b* of the driving side drum flange 63 are engaged with each other, so that the drum 62 is rotated via the driving side drum flange 63.

Incidentally, when the apparatus main assembly A is packed and transported in the state in which the cartridge B is mounted in the apparatus main assembly A, it is preferable that the drive transmitting portion 81*b* of the drive transmitting member 81 and the drive receiving portion 63*b* of the driving side drum flange 63 are engaged with each other. As a result, the drive transmitting member 81 supports the driving side drum flange 63, and therefore, movement of the cartridge B in the apparatus main assembly A can be prevented during transportation of the apparatus main assembly A, so that it is possible to suppress breakage of a part of the cartridge B by collision with component parts in the apparatus main assembly A due to impact and vibration during the transportation of the apparatus main assembly A.

Therefore, in the neighborhood of an engaged portion between the apparatus main assembly A and the cartridge B on the driving side, there is no need to provide a cushioning member for preventing collision therebetween in a gap between the apparatus main assembly A and the cartridge B. On the other hand, on the non-driving side, a cushioning member 85 is provided as shown in FIG. 20.

<Memory Portion>

A memory portion (memory for storing information on the cartridge B) of the cartridge B during the mounting of the cartridge B will be described using FIGS. 10A to 10D and part (b) of FIG. 21.

Figure 10A:
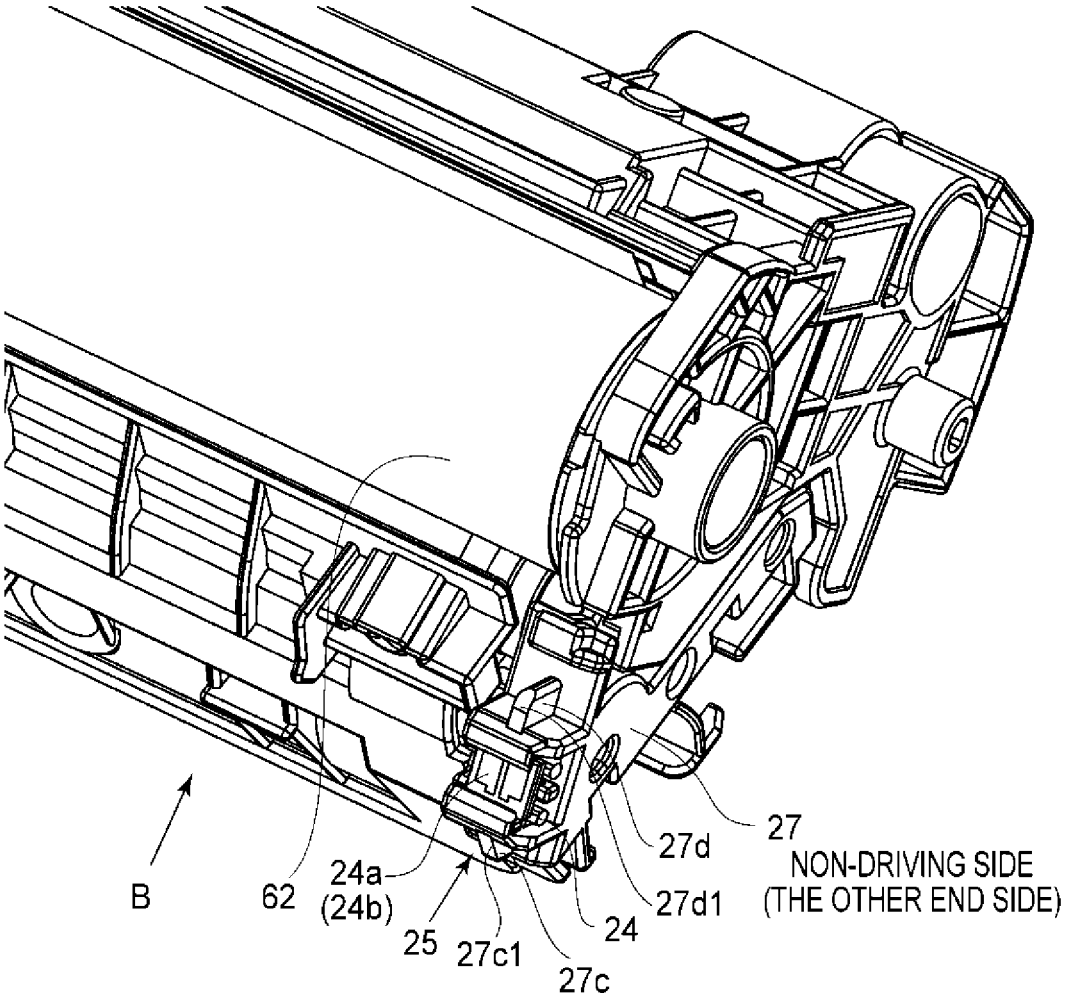
Figure 10B:
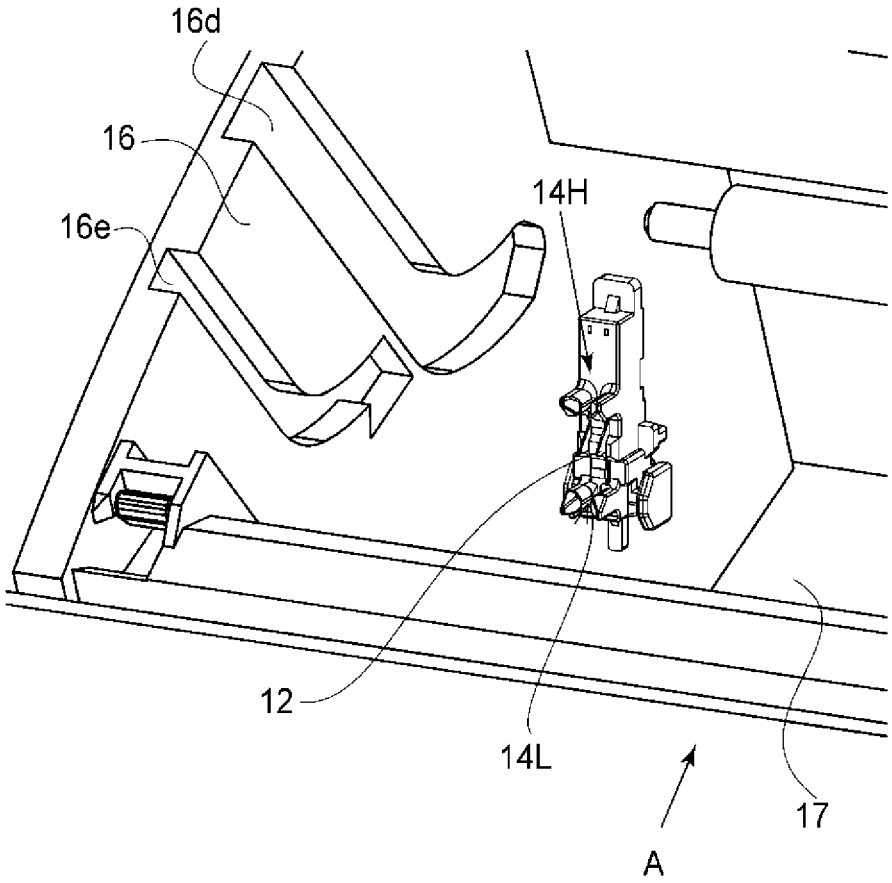
Figure 10C:
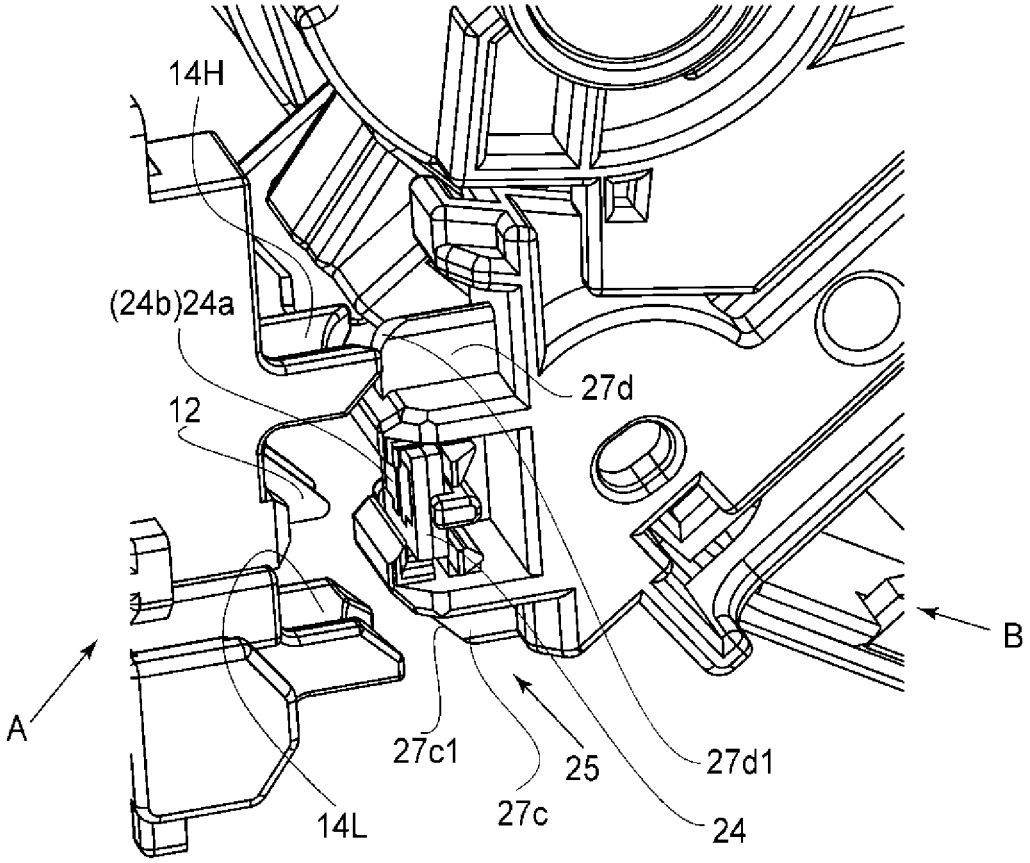
Figure 10D:
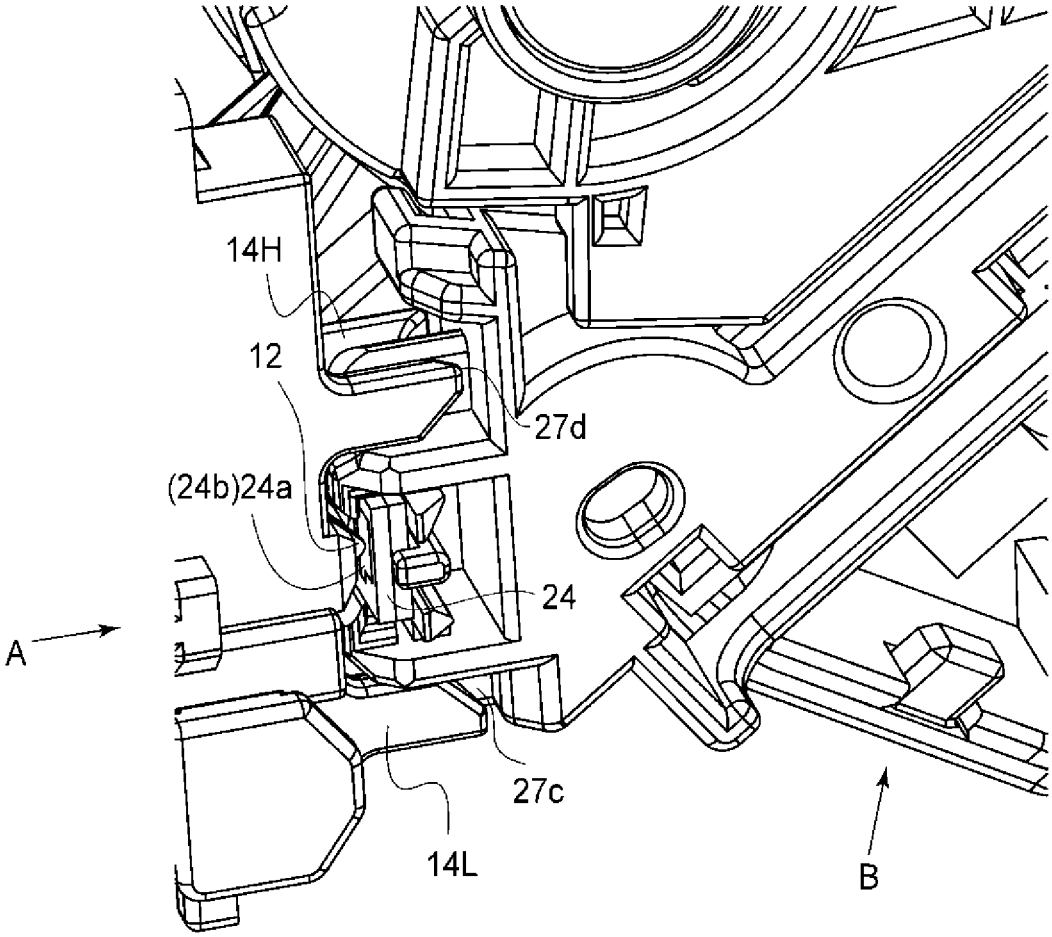

FIG. 10A is a schematic view showing a structure of a memory portion 24 of the cartridge B. FIG. 10B is a schematic view showing a structure of a memory contact portion (main assembly contact) 12 of the apparatus main assembly A. FIG. 10C is a schematic view showing a state before the memory portion 24 is connected before the mounting of the cartridge B is completed. FIG. 10D is a schematic view showing a state in which the memory portion 24 is connected after the mounting of the cartridge B is completed. Part (b) of FIG. 21 is a schematic view showing a structure of a memory contact portion of the apparatus main assembly A.

As shown in FIG. 10A, the cartridge B is provided with the memory portion (hereinafter, referred to as a memory tag) 24 which communicates with the controller (information reading and writing portion) of the apparatus main assembly A and which includes an electrical contact (memory contact) 24*b* through which information is inputted and outputted. A guide 27*c* and an upper guide 27*d* are provided adjacently to the memory tag 24. The guides 27*c* and 27*d* guide portions-to-be-guided 14H and 14L provided in the apparatus main assembly A and guide the memory contact portion (main assembly contact) 12, provided in the apparatus main assembly A, to the memory contact 24*b* of the memory 24 when the cartridge B is mounted in the apparatus main assembly A.

In this embodiment, the memory tag 24 is mounted on the bearing member 27 on the non-driving side, and the guide 27*c* is formed as a part of the bearing member 27.

As shown in FIG. 10B and part (b) of FIG. 21, the apparatus main assembly A includes the main assembly contact 12 communicating with the electrical contact (memory contact) 24*b* of the memory tag 24 and includes the portions-to-be-guided 14H and 14L adjacent to the main assembly contact 12. Further, the main assembly contact 12 and the portions-to-be-guided 14H and 14L are integrally movable relative to the apparatus main assembly A.

An operation in which when the cartridge B is mounted in the apparatus main assembly A, the electrical contact 24*b* of the memory tag 24 contacts the main assembly contact 12 and thus the memory tag 24 and the controller of the apparatus main assembly A are in a communicatable state will be described.

When the cartridge B is mounted, as shown in FIG. 10C, the portion-to-be-guided 14L and the guide 27*c* of the cartridge B engage with each other, and the portion-to-be-guided 14H and the upper guide 27*d* engage with each other. Further, the portions-to-be-guided 14H and 14L and the main assembly contact 12 are moved so as to follow the memory tag 24 and are positioned relative to the memory tag 24. As shown in FIG. 10D, when the mounting of the cartridge B is completed, the main assembly contact 12 and the electrical contact 24*b* of the memory tag 24 contact each other, so that the memory tag 24 and the controller of the apparatus main assembly A are in an electrically communicatable state.

<Supporting Structure in Cartridge Mounted State>

Next, a supporting structure, which is a primary point of this embodiment, when the cartridge B is mounted (installed) on a horizontal placement surface (installing surface) F such as a floor or a desk will be described using FIG. 1. Parts (a) and (b) of FIG. 1 are schematic views for illustrating a state in which the cartridge B is placed on the horizontal placement surface F.

When the cartridge B is placed on the horizontal placement surface F in a state in which the grip portion 71*f* is gripped, a bottom 30 of the cartridge B moves toward the horizontal placement surface F. Here, the bottom 30 is provided with a supporting portion 25 for stably supporting an attitude of the cartridge B. The supporting portion 25 is constituted by the guide 27*c*, and the guide 27*c* has a chamfered surface 27*c*1. In other words, the guide 27*c* constituted a part of the supporting portion 25.

Figure 1:
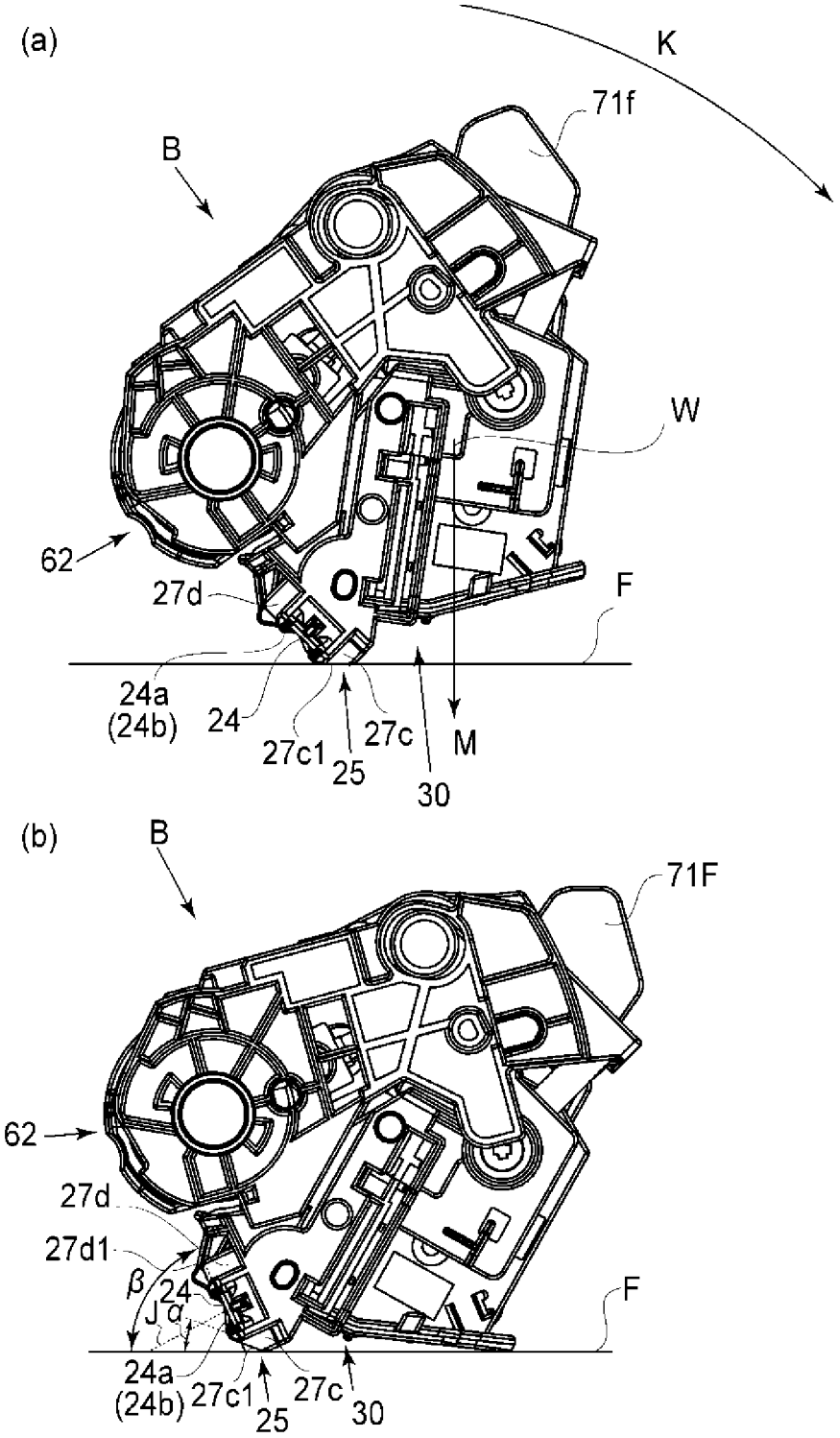

That is, as shown in part (a) of FIG. 1, the supporting portion 25 which is provided on the bottom 30 of the cartridge B when the cartridge B is hung by gripping the grip portion 71*f* and which supports the cartridge B when the cartridge B is placed on the horizontal placement surface F is provided. Further, the chamfered surface 27*c*1 formed by subjecting the guide 27*c* to chamfering (beveling) is provided.

As shown in part (b) of FIG. 1, in the state in which the cartridge B is placed on the horizontal placement surface F, an angle α of the chamfered surface 27*c*1 is 0° to 20°. As shown in FIG. 1, the chamfered surface 27*c*1 is substantially parallel to the horizontal placement surface F. Accordingly, even when the user applies a force to the cartridge B in a direction opposite to an arrow K direction, at a position where the cartridge B is rotated in the opposite direction by some angle, the chamfered surface 27*c*1 contacts the horizontal placement surface F as a whole and thus prevents (limits) rotational motion of the cartridge B.

Specifically, a force by the rotational motion of the cartridge B in the opposite direction to the arrow K direction is received by the chamfered surface 27*c*1, so that the chamfered surface 27*c*1 prevents the rotational motion of the cartridge B in the opposite direction is prevented. Thus, the chamfered surface 27*c*1 not only functions as a force receiving portion but also functions as a preventing portion for preventing the rotational motion of the cartridge B.

Incidentally, the rotational motion refers to rotational motion in which the cartridge B rotates about, as an axis, a line extending in a direction perpendicular to the drawing sheet of FIG. 1. An (inclination) angle β of a contactable surface 24*a* (of the memory contact 24*b*) on a side where the memory tag 24 is contactable to the main assembly contact 12 is 45° or more with respect to the horizontal placement surface F, so that a normal J to the surface 24*a* crosses the horizontal placement surface F. At this time, the surface 24*a* is disposed so as to be spaced from the horizontal placement surface F upwardly.

That is, the memory contact 24*a* is disposed so that the normal to the contactable surface where the memory contact 24*a* is contactable to the main assembly contact 12 crosses the horizontal placement surface F and so that the contactable surface is spaced from the horizontal placement surface F with an increasing level of the contactable surface.

In the case of part (b) of FIG. 1, the angle α is larger than 0°. When the user grips the grip portion 71*f* and intends to mount the cartridge B on the horizontal placement surface F, it is assumed that the photosensitive drum 62 is in a position where the cartridge B is further rotated counterclockwisely about a center thereof in cross section from the state of part (b) of FIG. 1. Also in this case, by making the angle α larger than 0°, the state of part (b) of FIG. 1 is easily reproduced, so that a situation such that the photosensitive drum 62 is contacted to and damaged by the horizontal placement surface F can be effectively preventing from occurring.

That is, the surface contacting the horizontal placement surface F at the supporting portion 25 when the cartridge B is supported by the supporting portion 25 is the chamfered surface 27*c*1. Further, the surface 24*a* of the memory contact 24*b* is inclined with respect to the horizontal placement surface F, and the chamfered surface 27*c*1 is parallel (substantially parallel) to the horizontal placement surface F.

As shown in part (a) of FIG. 1, when the cartridge B is placed on the horizontal placement surface F in a state in which the supporting portion 25 contacts the horizontal placement surface F, a position of the center of gravity W of the cartridge B is on a side opposite from the drum 62 with respect to the supporting portion 25. For that reason, the cartridge B is rotationally moved in the arrow K direction by a force M on which the center of gravity W acts, so that as shown in part (b) of FIG. 1, the attitude of the cartridge b is stabilized in a state in which the horizontal placement surface F and the chamfered surface 27*c*1 are in contact with each other.

Thus, the supporting portion 25 is formed relative to the position of the center of gravity W, so that the cartridge B is not rotationally moved in a direction of the drum 62, and therefore, an occurrence of damage on the drum 62 (cartridge constituting member) due to falling-down of the cartridge B can be suppressed. Further, also on the driving side, similarly, the bearing member 26 is provided with a projected portion 26*d* as shown in part (a) of FIG. 19 so that the attitude of the cartridge B is stabilized.

Further, when the cartridge B is placed on the horizontal placement surface F, the chamfered surface 27*c*1 of the guide 27*c* opposes the horizontal placement surface F in a substantially parallel relationship and contacts the horizontal placement surface F from that state. For this reason, when the chamfered surface 27*c*1 contacts the horizontal placement surface F at a surface (in a state closer to parallel state) compared with the case where the cartridge B contacts the horizontal placement surface F at an edge thereof, deformation and breakage of the guide 27*c* can be suppressed. In the case where a shape of the chamfered surface 27*c*1 is made equal to a shape of the upper chamfered surface 27*d*1, the chamfered surface 27*c*1 contacts the horizontal placement surface F with a stronger pressure, so that the deformation and breakage of the guide 27*c* are liable to be caused.

In the case where the guide 27*c* is broken, there is also a liability that a guiding function of the guide 27*c* is impaired and connection between the contact portion (main assembly contact) 12 and the electrical contact (memory contact) 24*b* is not satisfactorily established.

According to the chamfered surface 27*c* of this embodiment, such a situation can be effectively prevented. Also from such a viewpoint, as described above, the angle α may desirably be 0° to 20°. That is, in a cross-section perpendicular to the longitudinal direction of the cartridge B, the chamfered surface 27*c*1 may desirably have the angle α of 0° to 20° with respect to the horizontal placement surface F.

Here, in this embodiment, also the upper guide 27*d* has an upper guide chamfered surface 27*d*1 (FIG. 10A), and a chamfered amount of the chamfered surface 27*c*1 of the guide 27*c* is larger than a chamfered amount of the upper guide chamfered surface 27*d*1 of the upper guide 27*d*. When the user grips the grip portion 71*f* and places the cartridge B on the horizontal placement surface F, the cartridge B can be contacted to the horizontal placement surface F at the chamfered surface 27*c*1 having a larger area than the upper chamfered surface 27*d*1, so that the user can stably place the cartridge B on the horizontal placement surface F. Also from such a viewpoint, the angle α may desirably be 0° to 20° as described above.

Incidentally, in this embodiment, the chamfered surface 27*c*1 has a shape such that the guide 27*c* is cut away in a rectilinear line so as to have an angle of 45°, but an effect of the present invention does not necessarily depend on this angle. Further, as in a modified embodiment of FIG. 12, the chamfered surface 27*c*1 may also have an arcuately chamfered surface having small curvature.

When the cartridge B is placed on the horizontal placement surface F, the memory is disposed above the chamfered surface 27*c*1. In a constitution in which the guide 27*c* for guiding the main assembly contact 12 to the memory tag 24 is provided, when the guide 27*c* is placed in contact with the horizontal placement surface F, the chamfered surface 27*c*1 of the guide 27*c* stabilizes the attitude of the cartridge B. As a result, it is possible to prevent damage on the drum 62.

Further, compared with the case where a corner of the guide 27*c* contacts the horizontal placement surface F, the chamfered surface 27*c*1 of the guide 27*c* contacts the horizontal placement surface F, so that it is possible to suppress deformation and breakage of the guide 27*c* itself. Therefore, the guide 27*c* stably engages with the portion-to-be-guided 14L and is capable of stably guiding the main assembly contact 12 and the portion-to-be-guided 14L With respect to functions, materials, shapes and relative arrangement of constituent elements described in the above embodiment and modified embodiment, the scope of the present invention is not intended to be limited only to these parameters.

Here, the cartridge is not limited to the process cartridge of the integral type as in the above-described embodiments. In the cartridge according to present invention, a process cartridge of a separation type including a process means other than the developing means and a developing cartridge including the developing means for developing the latent image formed on the image bearing member.

According to the above description, in the constitution in which the guide for guiding the main assembly contact to the memory contact, when the guide is placed on the horizontal placement surface in contact with the horizontal placement surface, the chamfered surface of the guide stabilizes the attitude of the cartridge, whereby damage on the constituent member can be prevented. Further, compared with the case where the corner of the guide contacts the horizontal placement surface, the chamfered surface of the guide contacts the horizontal placement surface, so that the deformation and the breakage of the guide itself can be suppressed and thus the guide can stably guide the main assembly contact.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2018-008680 filed on Jan. 23, 2018 and 2018-044160 filed on Mar. 12, 2018, which are hereby incorporated by reference herein in their entirety.

What is claimed is:

1. A cartridge mountable to and dismountable from a main assembly of an image forming apparatus and usable for forming an image on a recording material, the cartridge comprising:

a memory configured to store information on the cartridge;

a guide configured to guide a portion to be guided provided in the main assembly and to guide a main assembly contact provided in the main assembly to a memory contact of the memory when the cartridge is mounted in the main assembly; and a grip portion, wherein the guide is provided at a bottom of the cartridge when the cartridge is hung by gripping the grip portion and constitutes a part of a supporting portion configured to support the cartridge when the cartridge is placed on a horizontal placement surface, wherein the guide has a surface opposing the horizontal placement surface when the cartridge is supported at the supporting portion, wherein a surface of the memory contact is inclined with respect to the horizontal placement surface and opposes the horizontal placement surface, and wherein the guide has a plate-like shape with a thickness with respect to a longitudinal direction of the cartridge.

2. A cartridge according to claim 1, wherein a normal extending in a direction in which the surface of the memory contact on a side contactable to the main assembly contact faces crosses the horizontal placement surface, and the surface of the memory contact is formed so as to be spaced from the horizontal placement surface upwardly.

3. A cartridge according to claim 1, wherein, in a cross section perpendicular to the longitudinal direction of the cartridge, the surface of the guide has an angle of 0° to 20° with respect the horizontal placement surface.

4. A cartridge according to claim 1, wherein, when the cartridge is placed on the horizontal placement surface, the memory is provided above the surface of the guide.

5. A cartridge according to claim 1, further comprising an image bearing member configured to form a latent image.

6. A cartridge according to claim 1, further comprising:

an image bearing member configured to form a latent image, and process means actable on the image bearing member.

7. A cartridge according to claim 6, wherein the process means is developing roller configured to develop the latent image.

8. A cartridge according to claim 1, further comprising developing means configured to develop a latent image formed on an image bearing member.

9. An image forming apparatus comprising:

a cartridge according to claim 1; and a transfer portion configured to transfer a toner image formed by the cartridge, onto the recording material.

* * * * *